US012564771B1

(12) United States Patent
Hobbs et al.

(10) Patent No.: US 12,564,771 B1
(45) **Date of Patent: *Mar. 3, 2026**

(54) GOLF CLUB HEAD

(71) Applicant: Cobra Golf Incorporated, Carlsbad, CA (US)

(72) Inventors: Bryce W. Hobbs, Escondido, CA (US); Ryan L. Roach, Encinitas, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 6 days.

This patent is subject to a terminal disclaimer.

(21) Appl. No.: 18/373,118

(22) Filed: Sep. 26, 2023

Related U.S. Application Data

(63) Continuation of application No. 17/741,699, filed on May 11, 2022, now Pat. No. 11,801,426.

(60) Provisional application No. 63/332,766, filed on Apr. 20, 2022.

(51) Int. Cl.
*A63B 53/04* (2015.01)

(52) U.S. Cl.
CPC ..... *A63B 53/0433* (2020.08); *A63B 53/0416* (2020.08); *A63B 53/047* (2013.01)

(58) Field of Classification Search
CPC . A63B 53/0416; A63B 53/042; A63B 53/045; A63B 53/047; A63B 53/0475
See application file for complete search history.

(56) References Cited

U.S. PATENT DOCUMENTS 3,970,236 A * 7/1976 Rogers ..... A63B 60/00 228/196
4,573,685 A * 3/1986 Young, IV ..... A63B 60/00 473/250
4,992,236 A * 2/1991 Shira ..... B22F 5/10 419/29
5,062,638 A * 11/1991 Shira ..... A63B 53/047 473/350
5,198,062 A * 3/1993 Chen ..... B29C 70/84 473/330
5,221,087 A * 6/1993 Fenton ..... A63B 53/04 473/342
5,290,032 A * 3/1994 Fenton ..... A63B 53/047 473/332
5,362,055 A * 11/1994 Rennie ..... A63B 53/0466 473/346
5,447,307 A * 9/1995 Antonious ..... A63B 53/047 473/350

(Continued)

FOREIGN PATENT DOCUMENTS

GB 2310379 A * 8/1997 ..... A63B 53/04
JP 05168732 A * 7/1993

(Continued)

*Primary Examiner* — Alvin A Hunter
(74) *Attorney, Agent, or Firm* — Quarles & Brady LLP

(57) ABSTRACT

A golf club head includes a body including a toe region, a heel region, and a medial region extending between the toe region and the heel region, and a face insert that is coupled to the body. The face insert and the body combine to form a front face on a front side. A top edge of the face insert is disposed within a face insert cavity and located between a central plane CP and a topline of the body. The face insert extends about 60% or less of a body height defined between the topline and the sole.

15 Claims, 15 Drawing Sheets

(56) References Cited

U.S. PATENT DOCUMENTS 5,547,194 A * 8/1996 Aizawa ..... A63B 53/047 473/350
5,766,092 A * 6/1998 Mimeur ..... A63B 60/00 473/332
5,842,934 A * 12/1998 Ezaki ..... A63B 60/00 473/349
D406,294 S * 3/1999 Burrows ..... D21/748
5,971,868 A * 10/1999 Kosmatka ..... A63B 69/3635 473/324
6,454,665 B2 * 9/2002 Antonious ..... A63B 53/047 473/346
6,517,448 B1 * 2/2003 Takeda ..... B23K 26/206 473/324
6,660,960 B2 * 12/2003 Takeda ..... B23K 33/00 219/121.64
7,029,403 B2 * 4/2006 Rice ..... A63B 60/00 473/345
7,066,834 B2 * 6/2006 Yamamoto ..... A63B 53/047 473/350
7,785,213 B2 * 8/2010 Matsunaga ..... A63B 53/0466 473/345
7,914,396 B2 * 3/2011 Imamoto ..... A63B 53/0466 473/345
8,021,246 B2 * 9/2011 Llewellyn ..... A63B 53/047 473/332
8,075,421 B2 * 12/2011 Hirano ..... A63B 53/04 473/345
8,157,668 B2 * 4/2012 Wahl ..... A63B 53/047 473/350
8,277,336 B2 * 10/2012 Hirano ..... A63B 53/0466 473/345
8,409,022 B2 * 4/2013 Oldknow ..... A63B 53/04 473/50
8,506,423 B2 * 8/2013 Oldknow ..... A63B 60/42 473/346
8,517,858 B2 * 8/2013 Soracco ..... A63B 60/02 473/345
8,821,313 B1 * 9/2014 Dawson ..... A63B 53/047 473/335
9,033,817 B2 * 5/2015 Snyder ..... A63B 60/54 473/332
9,387,370 B2 * 7/2016 Hebreo ..... B21K 17/00
9,616,303 B2 * 4/2017 Wu ..... A63B 60/02
9,717,959 B2 * 8/2017 Stites ..... A63B 60/02
9,814,946 B2 * 11/2017 Yamasawa ..... A63B 60/00
9,884,230 B2 * 2/2018 Snyder ..... A63B 60/54
9,993,704 B2 * 6/2018 Hebreo ..... A63B 60/00
10,065,089 B2 * 9/2018 Park ..... A63B 53/047
10,150,019 B2 * 12/2018 Ines ..... A63B 60/00
10,391,370 B2 * 8/2019 Tassistro ..... A63B 53/06
10,398,951 B2 * 9/2019 Golden ..... B21K 17/00
10,625,126 B2 * 4/2020 Demkowski ..... A63B 60/00
10,821,338 B2 * 11/2020 Hebreo ..... A63B 53/047
10,953,293 B2 * 3/2021 Demkowski ..... A63B 60/00
11,065,513 B2 * 7/2021 Tassistro ..... A63B 53/0475
11,351,426 B2 * 6/2022 Demkowski ..... A63B 60/00
11,559,727 B2 * 1/2023 Demkowski ..... A63B 60/50
11,801,426 B1 * 10/2023 Hobbs ..... A63B 53/045
2002/0037774 A1 * 3/2002 Miyamoto ..... A63B 60/00 473/287
2008/0076597 A1 * 3/2008 Roach ..... C25D 5/022 473/330
2010/0267467 A1 * 10/2010 Stites ..... A63B 53/0466 473/324
2011/0028240 A1 * 2/2011 Wahl ..... A63B 53/047 473/346
2011/0230279 A1 * 9/2011 Oldknow ..... A63B 60/02 473/350
2013/0109497 A1 * 5/2013 Ban ..... A63B 53/047 473/330
2013/0288823 A1 * 10/2013 Hebreo ..... B21K 17/00 72/352
2014/0073450 A1 * 3/2014 Hebreo ..... B21K 17/00 473/342
2015/0111660 A1 * 4/2015 Wu ..... A63B 53/06 473/331
2016/0038796 A1 * 2/2016 Taylor ..... A63B 53/047
2016/0184669 A1 * 6/2016 Deshmukh ..... C22C 19/03 473/335
2016/0287955 A1 * 10/2016 Ritchie ..... C22C 38/00
2016/0296809 A1 * 10/2016 Golden ..... A63B 53/047
2017/0065858 A1 * 3/2017 Tassistro ..... A63B 60/02
2018/0028879 A1 * 2/2018 Ines ..... A63B 53/047
2018/0036605 A1 * 2/2018 Tassistro ..... B21K 17/00
2018/0093145 A1 * 4/2018 Ripp ..... A63B 60/50
2018/0185715 A1 * 7/2018 Demkowski ..... A63B 53/0466
2018/0339207 A1 * 11/2018 Hebreo ..... A63B 53/06
2019/0118049 A1 * 4/2019 Tassistro ..... B21K 17/00
2019/0134473 A1 * 5/2019 Golden ..... A63B 53/0408
2019/0168087 A1 * 6/2019 Martens ..... A63B 53/0466
2019/0201760 A1 * 7/2019 Golden ..... A63B 60/52
2019/0255397 A1 * 8/2019 Hebreo ..... A63B 53/047
2019/0336832 A1 * 11/2019 Parsons ..... A63B 53/04
2020/0129824 A1 * 4/2020 Blevins ..... G06F 16/51
2020/0346077 A1 * 11/2020 Aplin ..... B22F 1/108
2021/0162275 A1 * 6/2021 Demkowski ..... A63B 53/0466
2022/0001248 A1 * 1/2022 Munson ..... A63B 53/0475
2022/0001249 A1 * 1/2022 Lambeth ..... A63B 60/52

FOREIGN PATENT DOCUMENTS

JP 07246261 A * 9/1995
KR 20060069225 A * 6/2006
WO WO-2011115749 A2 * 9/2011 ..... A63B 53/04

* cited by examiner

GOLF CLUB HEAD

CROSS REFERENCE TO RELATED APPLICATIONS

The present application is a non-provisional application and claims priority to U.S. application Ser. No. 17/741,699, filed on May 11, 2022, which claims priority to U.S. Provisional App. No. 63/332,766, filed on Apr. 20, 2022, each of which is incorporated by reference in its entirety.

REFERENCE REGARDING FEDERALLY SPONSORED RESEARCH OR DEVELOPMENT

Not applicable.

SEQUENCE LISTING

Not applicable.

BACKGROUND

1. Field of the Disclosure

The present disclosure relates to golf clubs, and more specifically to a golf club head that includes a face insert.

2. Description of the Background of the Disclosure

Different types of golf clubs are used to effect different types of shots, based on a golfer's location and ball lie when playing a hole on a golf course. An iron is a golf club that is used to make a variety of shots on a golf hole, for example, approach shots, bunker shots, chips, etc. Conventional iron-type golf club heads may include a face insert that is attached to a body. For example, a conventional face insert may be in the form of a generally 2-D plate (although with a nominal thickness or a variable thickness) that is welded around the periphery of the insert to adjoin to the body.

Generally, for a given lofted club, golf ball travel distance is a function of the total kinetic energy imparted to the ball during impact with the club head, neglecting environmental effects. During impact, kinetic energy is transferred from the club so that it is stored as elastic strain energy in the club head and as viscoelastic strain energy in the ball. After impact, the stored energy in the ball and in the club is transformed back into kinetic energy in the form of translational and rotational velocity of the ball, as well as the club. Since the collision is not perfectly elastic, a portion of energy is dissipated in club head vibration and viscoelastic relaxation of the ball, which is a material property of the polymeric materials used in all manufactured golf balls.

Viscoelastic relaxation of the ball is a parasitic energy source, which is dependent upon the rate of deformation. To decrease or minimize this effect, the rate of deformation must be reduced, which may be accomplished by allowing more face insert deformation during impact. Since metallic deformation may be purely elastic, the strain energy stored in the face insert is returned to the ball after impact, which may increase the ball's outbound velocity after impact. A variety of techniques may be used to vary the allowable deformation of the face insert, including uniform face thinning, thinned faces with ribbed stiffeners and varying thickness, and other techniques.

In general, conventional golf club heads may include a face insert that is coupled (e.g., welded) to a body. The body typically makes up the majority of the golf club head's total mass, and the mass of the body is positioned toward the sole and the trailing edge (e.g., an edge of a golf club head that is arranged at the intersection between the sole and the rear or back face of the golf club head) of the body to promote higher launch angle and lower center of gravity. The arrangement of the mass in the body increases a thickness and a stiffness in these portions of the body, which reduces flexibility and accordingly diminishes forgiveness and distance provided by the golf club head.

Typically, the iron is constructed to exhibit the highest COR at the geometric face center. The geometric face center is defined as a "hot spot" that is typically the location of the highest COR. As mentioned, when a golfer hits a shot, there is always some energy lost when the club hits the ball. At impact, the ball is compressed against the club face and the compression of the ball is where the energy is lost. With high COR, the face flexes inward so the ball is not compressed as much. This enables the ball to lose less energy due to the reduced compression against the face so that the ball comes off the face at a higher velocity and ultimately provides more distance. Unfortunately, the impact point of many golfers is far away from the geometric face center resulting in lower COR. For example, many golfers hit the face about 15 to 17 mm above the ground plane, which is well below the geometric face center. As the point of impact moves away from the geometric center, the COR falls dramatically within just a few millimeters.

Many golfers at all skill levels constantly seek to improve their performance and lower their golf scores. As a result, players are frequently seeking updated and improved equipment. The performance of a golf club can vary based on several factors, including face insert design. If golfers can hit a high COR part of the face more frequently, many golfers would benefit from more distance.

SUMMARY

The present disclosure provides a golf club head that includes a body and a face insert. In some aspects, a golf club head includes a body including a toe region, a heel region, and a medial region extending between the toe region and the heel region, and a face insert that is coupled to the body. A top edge of the face insert is disposed within a face insert cavity and located between a central plane CP and a topline of the body.

In some aspects, a golf club head includes a body that includes a face insert cavity and a face insert that is received within the face insert cavity. A front face is defined by the body and the face insert on a front side. The body includes a bridge stiffener extending rearwardly from the front face and the bridge stiffener extends across the body from a heel region to a toe region.

In some aspects, a golf club head includes a body defining an insert cavity and a face insert that is received within the face insert cavity. A front face is formed by the body and the face insert on a front side. A geometric center of the front face is located between a sole and a topline and an impact point of the front face is located between the geometric center and the sole.

In some aspects, a golf club head includes a body including a toe region, a heel region, and a medial region extending between the toe region and the heel region, and a face insert that is coupled to the body. The face insert and the body combine to form a front face on a front side. A top edge of the face insert is disposed within a face insert cavity and located between a central plane CP and a topline of the body. The face insert extends about 60% or less of a body height defined between the topline and the sole. A bridge stiffener connects the face insert to a rear structure of the body.

In some embodiments, the face insert defines less than about 50% of a surface area of the front face. In some embodiments, the face insert includes a sole portion that is coupled to the sole. In some embodiments, an ideal impact point of the front face is located between the sole and the topline. In some embodiments, an inner surface of the face insert includes a plurality of concentric zones of varying thickness centered about the ideal impact point.

In some aspects, a golf club head includes a body that includes a face insert cavity, and a face insert that is received within the face insert cavity. A front face is defined by the body and the face insert on a front side, and the body includes a bridge stiffener extending rearwardly from the front face. The bridge stiffener connects the face insert to a rear structure of the body. The rear structure of the body extends from a trailing edge of the body to the bridge stiffener and at least partially defines an internal cavity between the rear structure and the face insert.

In some embodiments, a filler insert is disposed in the internal cavity, the filler insert having a hardness between about Shore A5 and about Shore A40. In some embodiments, the internal cavity includes an upper internal cavity and a lower internal cavity, and the bridge stiffener separates the upper internal cavity from the lower internal cavity. In some embodiments, the bridge stiffener includes a convex portion extending between the rear structure of the body and the face insert. In some embodiments, the bridge stiffener includes a concave portion extending between the rear structure of the body and the face insert. In some embodiments, the concave portion defines a concave tab that extends downwardly from the bridge stiffener to the rear structure. In some embodiments, the concave tab forms a rear opening in communication with the internal cavity. The internal cavity is exposed through the rear opening.

In some aspects, a golf club head includes a body that includes a face insert cavity and a face insert that is received within the face insert cavity. A front face is defined by the body and the face insert on a front side, and the body includes a bridge stiffener extending rearwardly from the front face. The bridge stiffener extends across the body from a heel region to a toe region at an intersection with an inner surface of the front face. The bridge stiffener separates an upper internal cavity from a lower internal cavity. The bridge stiffener includes at least one of a concave portion and a convex portion.

In some embodiments, a filler insert is disposed in the lower internal cavity, the filler insert defining a hardness between about Shore A5 and about Shore A40. In some embodiments, a height of the lower internal cavity is about 20% of a body height defined between a topline of the body and a sole of the body. In some embodiments, a geometric center of the front face is located between a topline of the body and a sole of the body, and wherein a center plane of the golf club head extends through the geometric center of the front face. In some embodiments, the body further includes a lower cavity structure extending between the sole and an upper middle part of the front face. In some embodiments, a majority of the lower cavity structure is located below the center plane. In some embodiments, the body further includes an upper cavity structure, and wherein a first thickness of the upper cavity structure is less than a second thickness of the lower cavity structure.

DETAILED DESCRIPTION OF THE DRAWINGS

Figure 1:
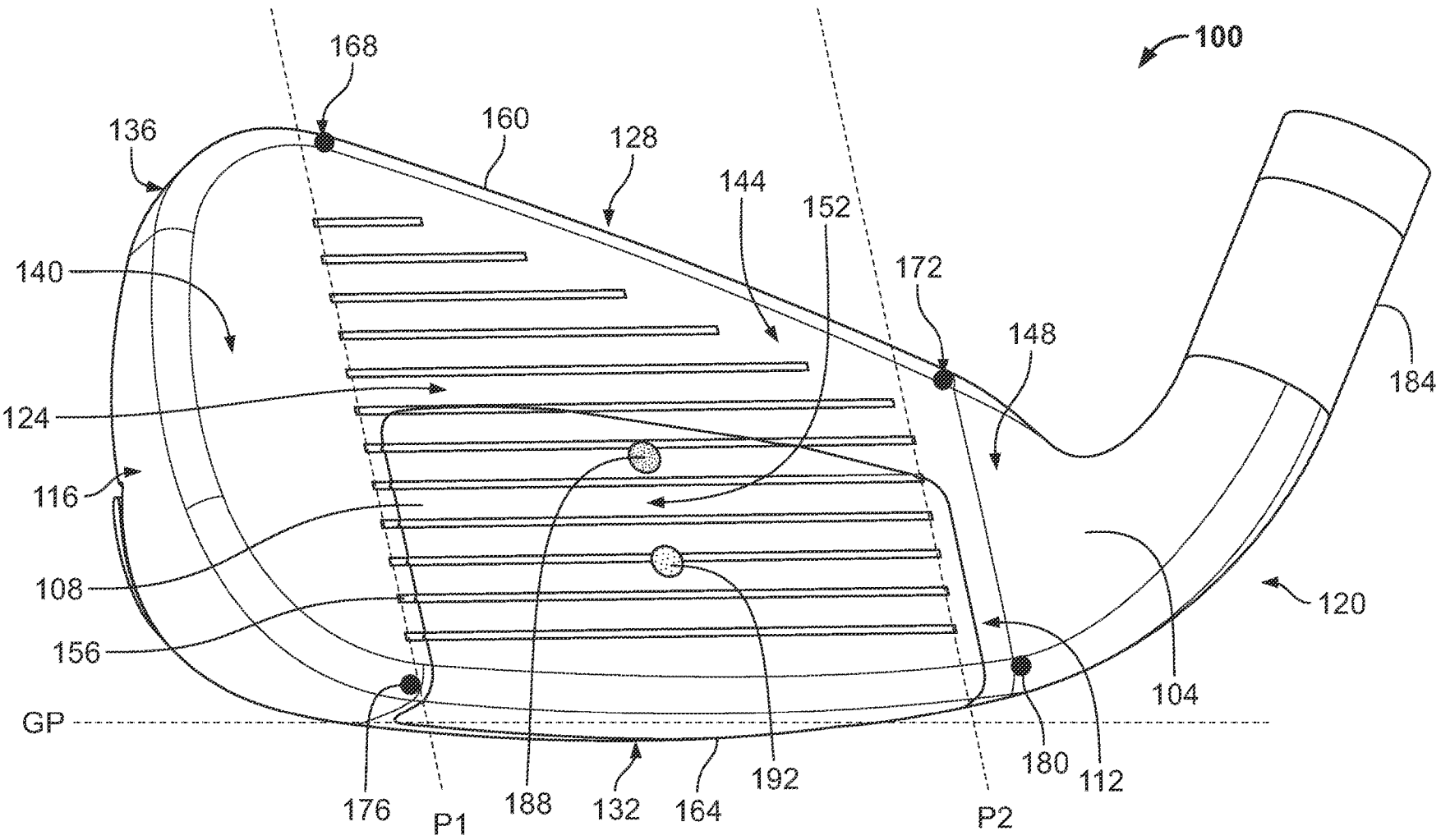
FIG. 1 is a bottom, front, left isometric view of an iron-type golf club head having a body and a face insert with a geometric center of the face and a typical impact location overlaid thereon.

The term "about," as used herein, refers to variations in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

In general, conventional golf club heads may include a face insert that is coupled (e.g., welded) to a body. The body typically makes up the majority of the golf club head's total mass, and the mass of the body is positioned toward the sole and the trailing edge (e.g., an edge of a golf club head that is arranged at the intersection between the sole and the rear or back face of the golf club head) of the body to promote a higher launch angle and lower center of gravity. The arrangement of the mass in the body increases the thickness and the stiffness in these portions of the body, which reduces flexibility and accordingly diminishes forgiveness and distance provided by the golf club head.

In some conventional golf club heads, the golf club heads are constructed to provide the highest coefficient of restitution (COR) at the geometric face center of the striking face. The COR is a fractional measurement that quantifies the loss of energy when two objects, the striking face and a golf club, collide. The COR provides a "trampoline effect," wherein the face of the golf club head is compressed in the course of the impact with the golf ball then rebounds like a spring to provide extra distance. Therefore, striking the golf ball near the geometric face center or a COR "hot spot" to obtain a high COR is desirable. Unfortunately, for most players, the point of impact with the ball is far away from the geometric center during a shot. The COR falls off and decreases considerably as the point of impact moves away from the geometric face center.

To overcome the COR fall off in conventional golf club heads, the present disclosure provides an iron-type golf club head with a body and a face insert. The body includes a cavity for a face insert and a bridge stiffener. The cavity extends from the sole but below the topline of the body. The bridge stiffener is defined near the upper middle part of the face but below the topline of the body. The bridge stiffener extends from an internal surface of the front face and is formed integrally with the body. The bridge stiffener protrudes from the internal surface in a direction towards the cavity back of the club body mimicking the shape of a crown of a hybrid club. In other words, the body comprises a generally thin shell structure with a bridge stiffener that may be reinforced by ribs and the inner surface of the shell body and the bridge stiffener defines an internal cavity of the body.

The face insert is defined within the face insert cavity near the front face. The shorter vertical span of the face insert provides the COR "hot spot" adjustment to a typical impact location of most players. A filler material may be injected or poured into the internal cavity of the body after the face insert is attached to the body. The filler insert may be injected into the cavity formed by the inner shell body and the bridge stiffener that is formed integrally with the body to provide the benefits of a hybrid-shape golf club head. The hybrid-shape golf club head provides a lower center of gravity and moves the center of gravity further back from the club face. In this way, for example, the filler material is configured to provide a rear shift in the center of gravity as well as lower the center of gravity for improved performance. In addition, the filler material may improve the vibration performance of the body and may reduce the sound generated by impact, which compensates for the thin shell structure defined by the majority of the body. The golf club head and the face insert may be provided in a variety of configurations and may take alternative forms than as shown and described hereinafter below.

Referring now to FIGS. 1-4, a golf club head 100, for example, an iron-type golf club head, is shown in accordance with the present disclosure. The iron-type golf club head 100 includes a body 104 and a face insert 108, which may be coupled to one another after machining of the body 104. In some embodiments, the face insert 108 may be manufactured from a different material than the body 104. For example, the body 104 and the face insert 108 may be manufactured from different metal or non-metallic materials (e.g., different types of stainless steel, carbon steel, titanium, aluminum and/or other metal alloys, polymers, or carbon composite). In some embodiments, the face insert 108 and the body 104 may be fabricated from the same type of material (e.g., the same type of stainless steel). When the iron-type golf club head is assembled, the face insert 108 is dimensioned to fit within a face insert cavity 112.

The iron-type golf club head 100 defines a toe side 116, a heel side 120, a front side or front end 124, a top side 128, a bottom side 132, and a rear side or rear end 136. The iron-type golf club head 100 further includes a toe region 140, a medial region 144, and a heel region 148. The toe region 140, the medial region 144, and the heel region 148 may be defined by lines or planes P1 and P2 that extend through the iron-type golf club head 100 in a sole-topline direction. The toe region 140 and the heel region 148 are arranged at laterally opposing ends of the body 104, and the medial region 144 is arranged laterally between the toe region 140 and the heel region 148.

The face insert 108 is attached to the front side 124 of the body 104 within the face insert cavity 112. The face insert 108 and the body 104 together, e.g., when combined or fitted joined together, define a front face 152 that extends from the toe region 140, through the medial region 144, and at least to a junction between the heel region 148 and the medial region 144. The front face 152 includes a plurality of laterally extending grooves 156 that are spaced apart from one another in the sole-topline direction. In some embodiments, the front face 152 may define a striking face that makes contact with a golf ball.

The iron-type golf club head 100 defines a topline 160 extending in an inclined heel-toe direction along the top side 128, and a sole 164 extending laterally in the heel-toe direction along the bottom side 132. In some embodiments, the heel-toe direction may be parallel to a ground plane GP that is defined as a plane that is parallel to the ground on which the iron-type golf club head 100 sits at address. The topline 160 may be formed by the top side 128 of the body 104, the face insert 108, or a combination of the body 104 and the face insert 108. Similarly, the sole 164 may be formed by the bottom side 132 of the body 104, the face insert 108, or a combination of the body 104 and the face insert 108.

The topline 160 may extend along the top side 128 from a toe-topline intersection point 168, along the medial region 144, to a heel-topline inflection point 172. The sole 164 may extend along the bottom side 132 from a toe-sole intersection point 176, along the medial region 144, to a heel-sole inflection point 180. A hosel 184 is connected to the body 104 around the heel side 120 extending upwards from the heel-sole inflection point 180.

Specifically referring to FIG. 1, the iron-type golf club head 100 includes a geometric center point 188 of the front face 152 that is represented by a red, or upper, dot overlaid on the face insert 108. Further, a typical impact location 192 is represented by a green, or lower, dot that is overlaid on the face insert 108 of the iron-type golf club head 100. As illustrated in FIG. 1, the geometric center point 188, i.e., the red dot reference point, is higher or farther from the sole 164 than the typical impact location 192, i.e., the green dot reference, where golfers typically make contact with the golf ball.

Figure 2:
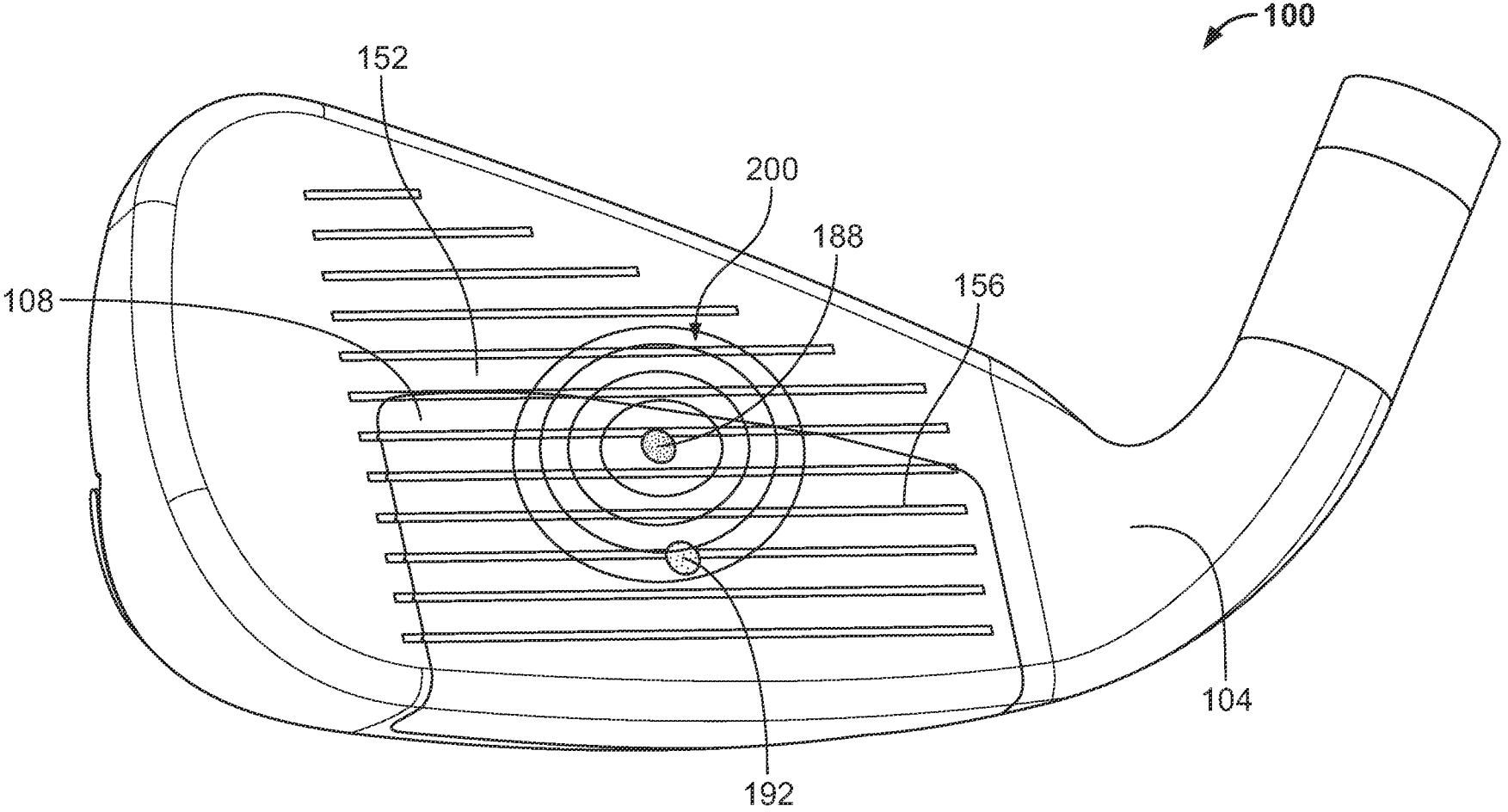
FIG. 2 is another bottom, front, left isometric view of the iron-type golf club head of FIG. 1 with concentric circles overlaid thereon illustrating the Coefficient of Restitution (COR) moving away from the geometric center point.

FIG. 2 depicts the iron-type golf club head 100 of FIG. 1 with concentric circles 200 overlaid thereon to illustrate decreasing Coefficient of Restitution (COR) relative to the geometric center point 188. In general, the geometric center point 188, i.e., the red dot reference point, corresponds with the location of a maximum COR, i.e., the "hot spot," such as a maximum conforming allowable COR of 0.83, upon impact with the golf ball. The impact near the geometric center point 188 of the face insert 108 provides a longer shot distance through a trampoline effect afforded by the construction of the iron-type golf club head 100. However, the COR diminishes as the point of impact moves away from the epicenter of the geometric center point 188, as illustrated by the concentric circles 200, where each circle may represent a COR reduction of about 0.02. For example, the COR can diminish from about 0.83 at the geometric center point 188 to about 0.75 at the outermost circle of the concentric circles 200, depending on the geometry of the front face 152.

Figure 3:
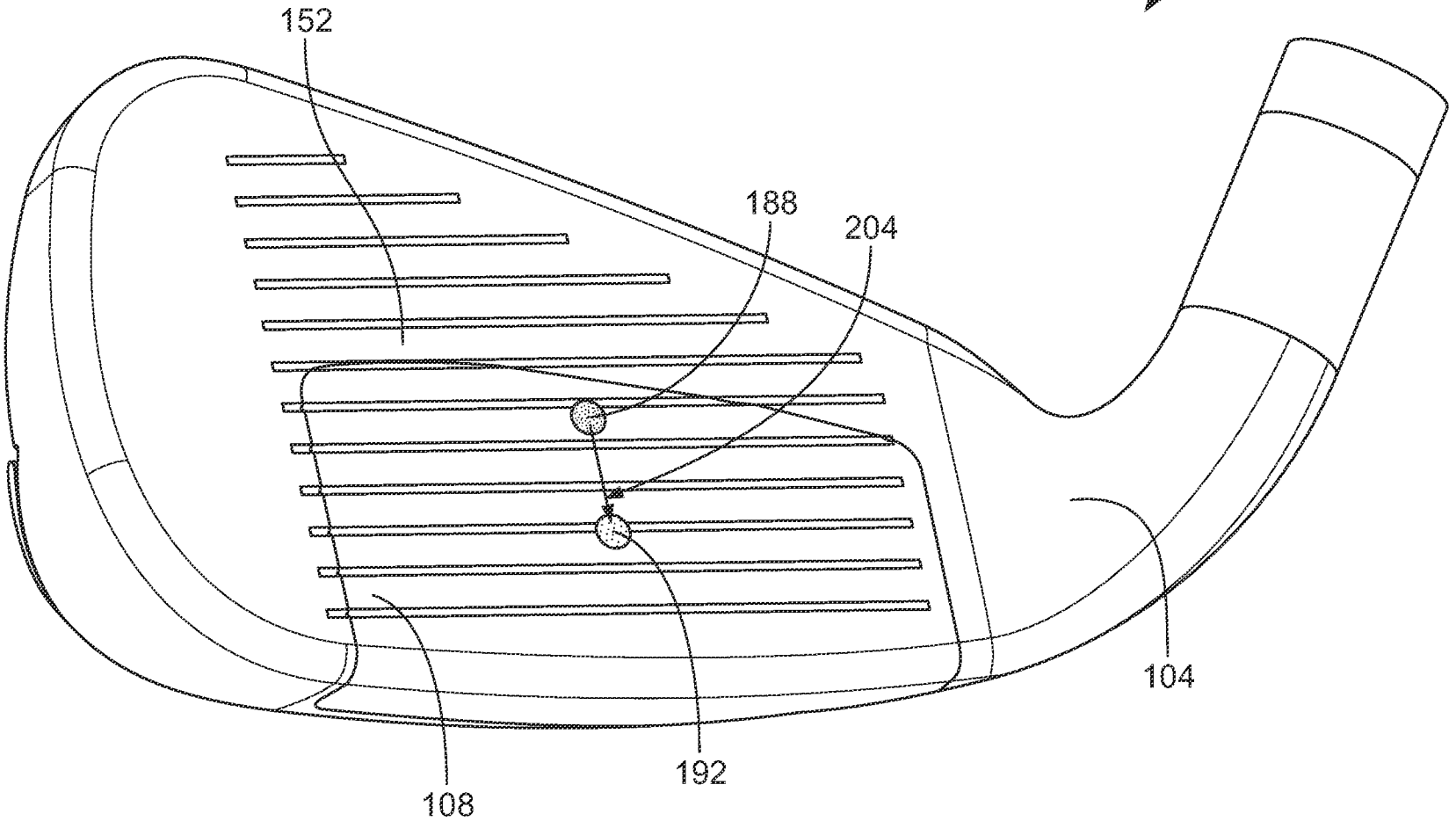
FIG. 3 is yet another bottom, front, left isometric view of the iron-type golf club head of FIG. 1 with an arrow overlaid thereon illustrating a desired change of the geometric center point toward the typical impact location.

Specifically referring to FIG. 3, the iron-type golf club head of FIG. 1 is shown with an arrow 204 overlaid thereon to illustrate a desired shift of the "hot spot" toward the typical impact location 192. In general, the typical impact location 192 on the front face 152 is between about 15 and about 17 mm above the ground plane GP (see FIG. 1), which is substantially below the geometric center point 188. The present disclosure relates to moving the COR "hot spot" from the geometric center point 188 to the typical impact location 192 to make the typical impact location 192 an ideal impact location that corresponds with the COR "hot spot." The COR "hot spot" is lowered by shortening the vertical span of the body 104 and/or the face insert 108 and enables the COR "hot spot" to be adjusted to or toward a typical impact location of most players.

Figure 4:
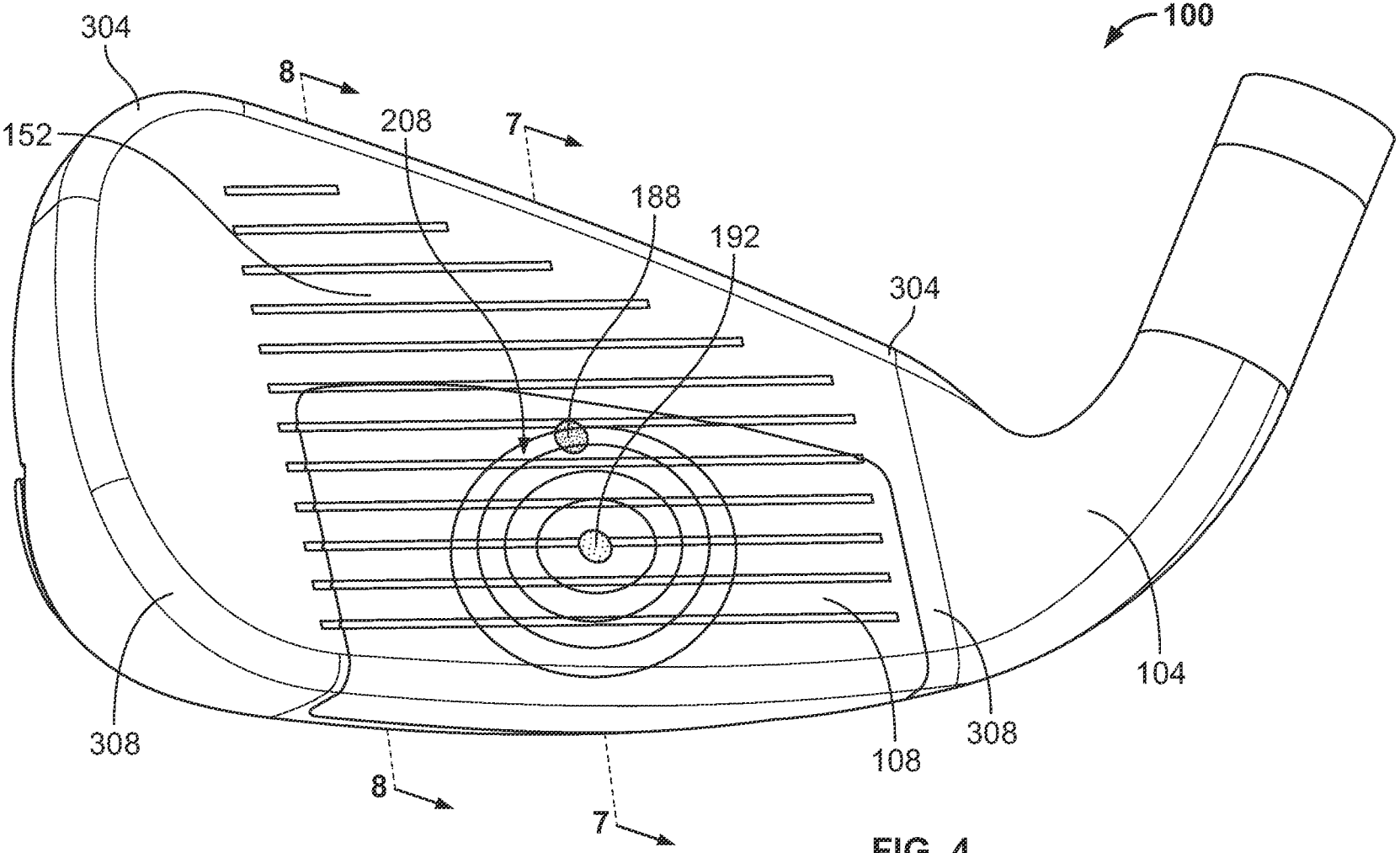
FIG. 4 is a bottom, front, left isometric view of the iron-type golf club head of FIG. 1 with the geometric center point of the face and concentric circle illustrated the COR moving away from the typical impact location.

Referring to FIG. 4, the iron-type golf club head 100 is depicted with the shifted "hot spot" or ideal impact point corresponding with the typical impact location 192 and overlaid with the concentric circles 208 reflecting decreasing COR values relative to the new "hot spot." That is, the epicenter of the new COR "hot spot" is coincident with the typical impact location 192 of the front face 152, which represented by the lower green dot. In the illustrated embodiment, the typical impact location 192, i.e., the new epicenter of the COR "hot spot," provides a COR of about 0.83, and the COR diminishes moving away from the typical impact location 192 toward, e.g., the geometric center point 188. In some embodiments, the geometric center point 188, which is represented by the higher red dot, may have a COR of about 0.75. By lowering the COR "hot spot" to the typical impact location 192, the iron-type golf club head 100 provides more golfers greater shot distance.

Figure 5:
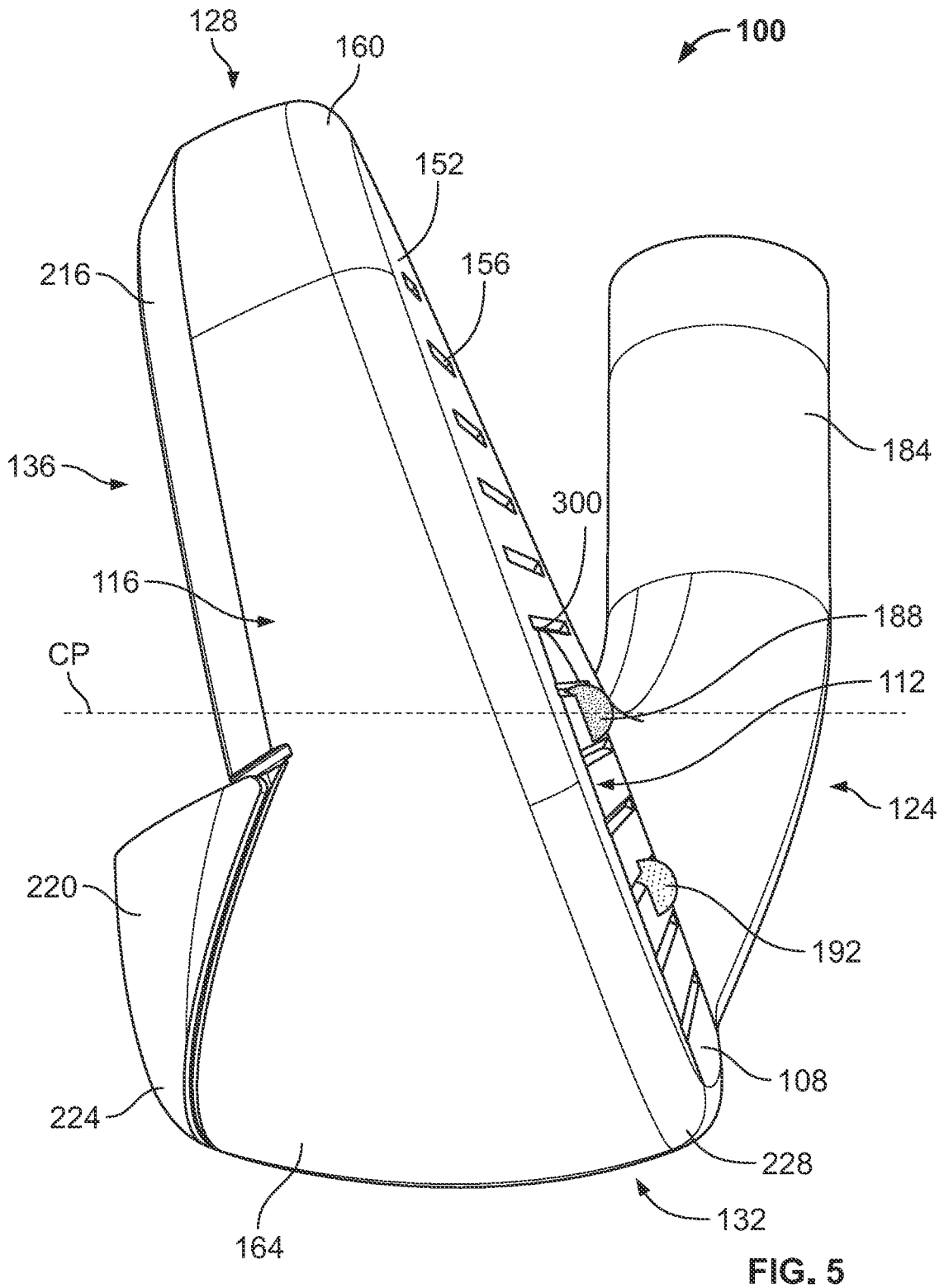
FIG. 5 is a left side elevational view of the iron-type golf club head of FIG. 1.
Figure 6:
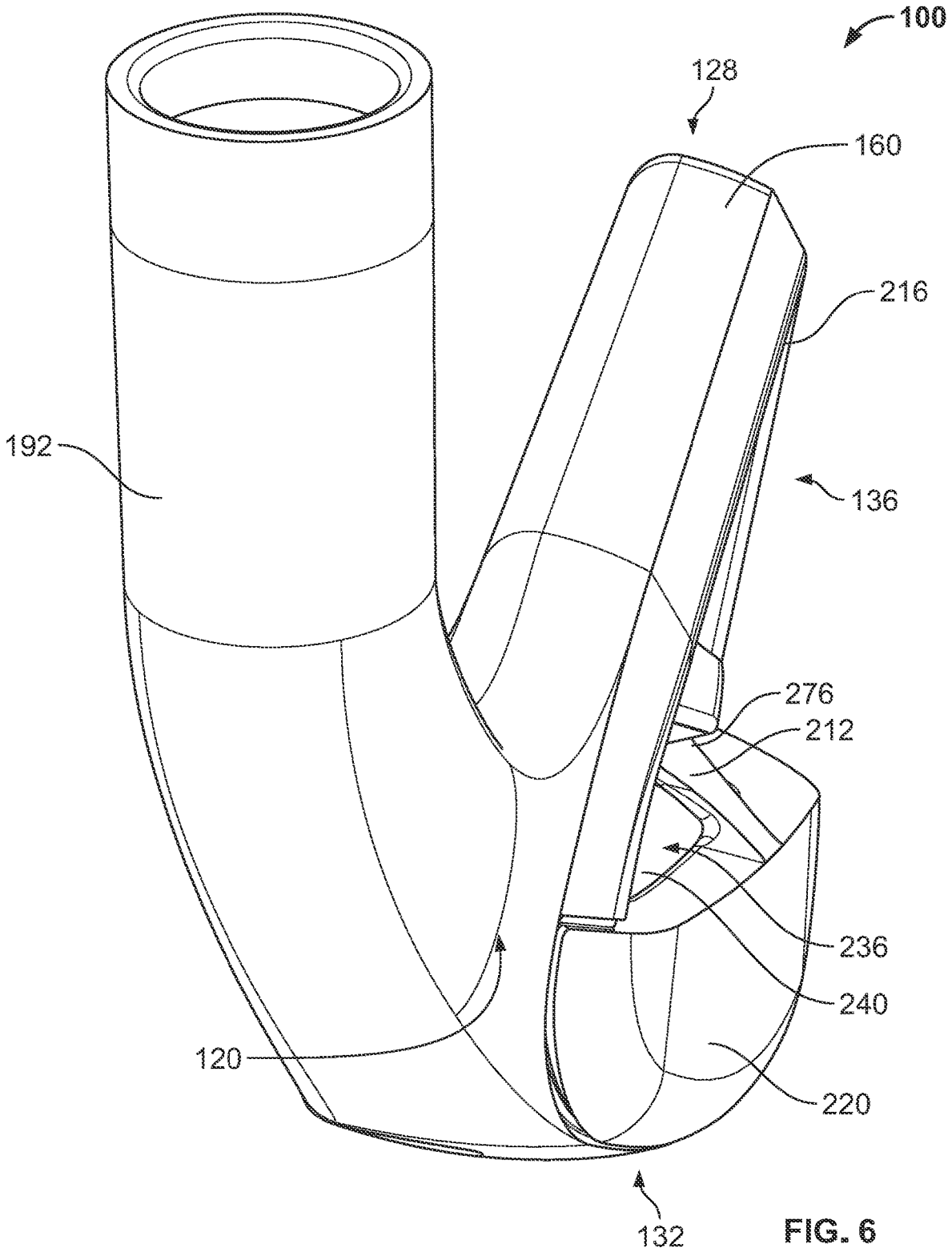
FIG. 6 is a right side elevational view of the iron-type golf club head of FIG. 1.

Turning to FIGS. 5 and 6, the body 104 may be formed as a unitary component (e.g., from a single piece of material). In some embodiments, the body 104 may be formed by a casting process, a forging process, a metal injection molding (MIM) process, or an additive manufacturing process (e.g., 3-D printing, such as DMLS, Directed Energy Deposition (DED), or binder jetting). The body 104 includes a hosel 184, a bridge stiffener 212, an upper rear cavity structure 216 provided in the form of an iron cavity back, and a lower rear cavity structure 220 resembling a hybrid crown that extends between the sole 164 and an upper middle part of the front face 152 but below the topline 160. A majority of the upper rear cavity structure 216 is positioned above a center plane CP (see FIG. 6) and a majority of the lower rear cavity structure 220 is located below the center plane CP, which passes through the geometric center point 188. The lower rear cavity structure 220 originates between the sole 164 and a trailing edge 224 of the iron-type golf club head 100. The lower rear cavity structure 220 bulges toward the rear side 136 of the iron-type golf club head 100, between the trailing edge 224 and the bridge stiffener 212, creating a structure similar to a hybrid crown. The depth or the front-to-back thickness of the upper rear cavity structure 216 is smaller, i.e., thinner, than the lower rear cavity structure 220. In some embodiments, the lower rear cavity structure 220 comprises a hollow internal cavity 232 that is exposed via a rear opening 236. In some embodiments, the hollow internal cavity 232 of the lower rear cavity structure 220 is filled with a polymer filler material 240 that may be exposed at the rear opening 236.

The hosel 184 is arranged within the heel region 148 of the body 104 and extends from the heel region 148 at an angle (e.g., a lie angle formed between a plane parallel to the ground on which the club head rests at address and a center axis defined through the hosel 184) in a direction away from the toe region 140. In some embodiments, the heel region 148 defines an aperture (not shown) that is disposed within the heel region 148 and is configured to receive and secure a shaft (not shown) of the golf club. The hosel 184 extends vertically from the top side 128. A shaft bore (not shown) extends from the hosel 184, the shaft bore being sized and shaped to receive the shaft (not shown), or an element that may be coupled with the shaft.

Figure 7:
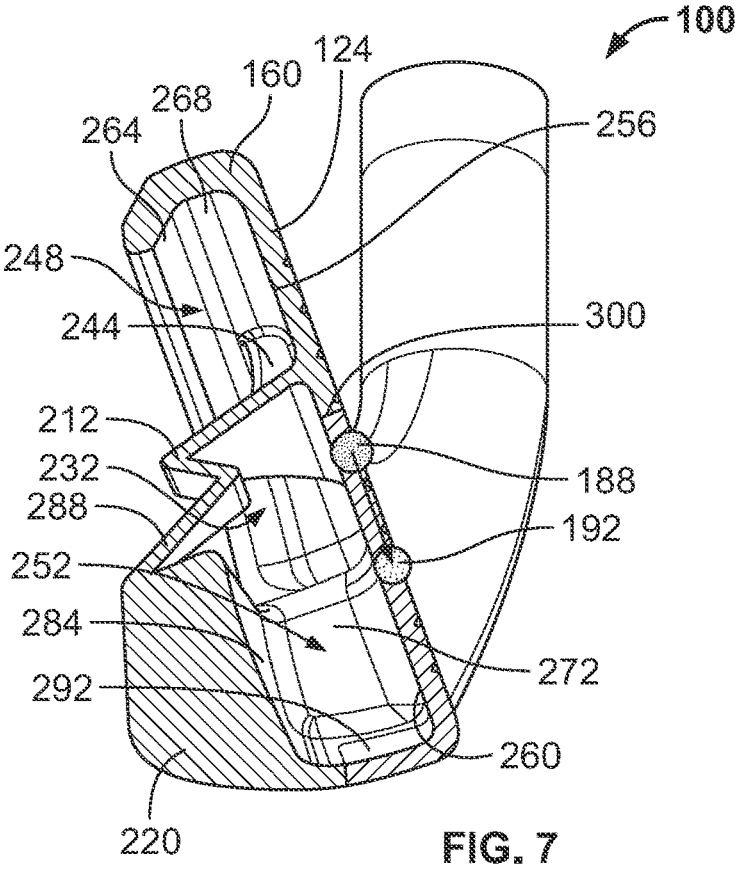
FIG. 7 is a cross-sectional view taken along line 7-7 of FIG. 4.

Referring to FIG. 7, a cross-sectional view taken along line 7-7 of FIG. 4 is shown. The body 104 includes a plurality of ribs 244, an upper internal cavity 248, a lower internal cavity 252, and a bridge stiffener 212. In general, the internal cavity 232 comprises the upper internal cavity 248 and the lower internal cavity 252, such that the body 104 defines a hollow volume. In the illustrated embodiment, the upper internal cavity 248 and the lower internal cavity 252 are separated by the bridge stiffener 212. The bridge stiffener 212 protrudes rearward from a rear side of the face insert 108 toward the rear side 136 of the body 104. The toe-heel profile of the bridge stiffener 212 may be an S-shape, a sinusoidal shape that includes at least one concave and one convex portion, a lightning bolt/zig-zag shape that extends from the inner surface 256 of the front side 124 of the body to the lower rear cavity structure 220 of the body 104, or another shape. Put another way, the bridge stiffener 212 may have a toe-heel profile shape that includes at least two inflection points between a first end at a rear side of the face insert 108 and a second end at a rear side 136 of the body 104, although it will be appreciated that the bridge stiffener could have a different toe-heel profile shape, e.g., without any inflection points. In this way, the bridge stiffener 212 is configured to deform or flex, thereby affording spring-like functionality for collecting and returning energy at impact with a golf ball. In the illustrated embodiment, as will be appreciated from the cross-sectional views of FIGS. 7 and 8, the bridge stiffener 212 includes a first segment that extends downward and away from the inner surface 256, a second segment that extends downward at an angle relative to the first segment and reverses direction toward the inner surface 256, and a third segment extending downward at an angle relative to the second segment and reverses direction again to extend away from the inner surface 256 to an intersection with the lower rear cavity structure 220. The bridge stiffener 212 may be reinforced by one or more ribs 244 that extend from the inner surface 256 of the front side 124 of the body 104 and join with or contact the first segment of the bridge stiffener 212, although the ribs 244 (or more than one rib) may not be used in one or more alternative aspects depending on various factors, e.g., the durability of the material used to form the body 104. In some examples, the plurality of ribs 244 includes a first rib that is disposed on the toe side 116 of the body 104 relative to the geometric center point 188 (see FIGS. 1 and 7) and a second rib disposed on the heel side 120 of the body 104 relative to the geometric center point 188. The upper internal cavity 248 is at least partially defined by an upper rearmost inner surface 264, a topline inner surface 268, the inner surface 256, an upper bridge stiffener surface 276 (see FIGS. 6 and 8) of the bridge stiffener 212, an upper heel inner surface 280, and an upper toe inner surface (not shown). The lower internal cavity 252 is at least partially defined by a lower rearmost inner surface 284, an inner face insert surface 260, a lower bridge stiffener surface 288 at the uppermost end of the lower internal cavity 252, a sole inner surface 292, a lower heel inner surface 272 (see FIG. 7), and a lower toe inner surface (not shown).

Figure 8:
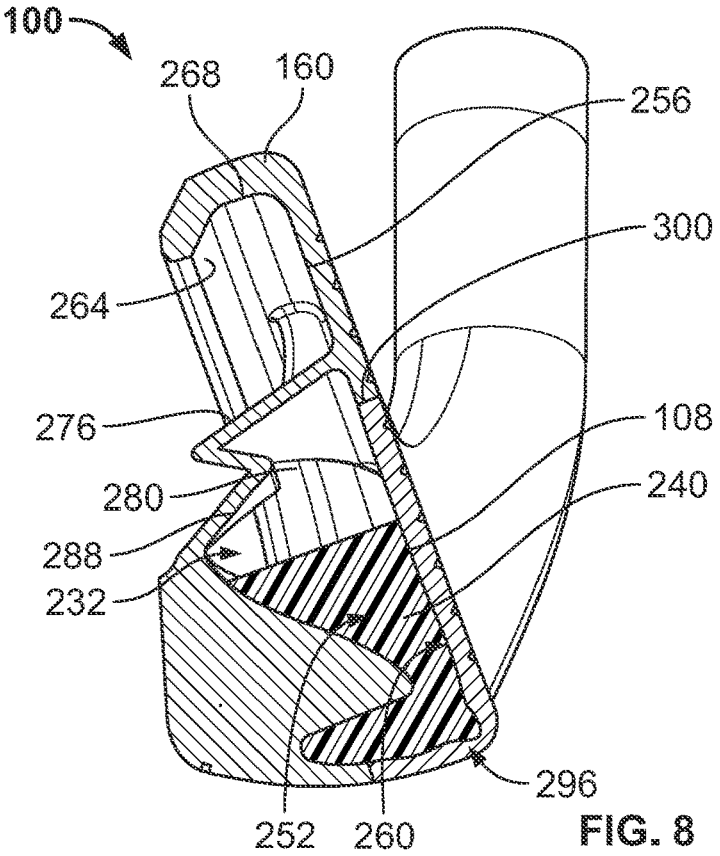
FIG. 8 is a cross-sectional view taken along line 8-8 of FIG. 4 and showing a filler material.

The face insert cavity 112 (see FIG. 13) partially extends from the leading edge 228 within the medial region 144 of the golf club head body 104. The face insert 108 is configured to be located within the face insert cavity 112 when the body 104 and the face insert 108 are joined together. The face insert 108 includes a plurality of laterally extending grooves 156 that are spaced apart from one another in the sole-to-topline direction between a bottom or sole portion 296 and a top side or top edge 300 of the face insert 108. In conventional iron-type golf club heads, the face insert 108 spans between the topline 160 and the leading edge 228 of the body 104 and comprises a generally large proportion, e.g., greater than 50%, of the front face 152. By contrast, the iron-type golf club head 100 provides the face insert cavity 112 and corresponding face insert 108 with a reduced vertical span, i.e., a shorter extent in the sole-topline direction, extending from the leading edge 228 of the face insert 108 toward the top side 128. Referring to FIGS. 5 and 8, the top edge 300 of the face insert 108 corresponds with a location of the bridge stiffener 212, so that the top edge 300 of the face insert 108 is located approximately centrally between the sole 164 and the topline 160 within at least one of the toe region 140, medial region 144, or the heel region 148. The face insert cavity 112 of the body 104 extends from the leading edge 228 on the sole 164 toward the topline 160 to a location that corresponds with the bridge stiffener 212, which is approximately midway between the sole 164 and the topline 160 within at least one of the toe region 140, the medial region 144, or the heel region 148. In the illustrated embodiment, the top edge 300 of the face insert 108 disposed within the face insert cavity 112 is located between the central plane CP and the topline 160. As a result, the face insert 108 is not only shorter than conventional face inserts for iron-type golf clubs, but the face insert 108 also comprises a smaller proportion, e.g., 50% or less, of the front face 152. Accordingly, the reduced size of the face insert 108 offers enhanced strength properties and shifts the COR "hot spot" downward toward the sole 164 to coincide with the typical impact location 192.

As illustrated in FIGS. 7 and 8, the thickness, e.g., the front-to-rear dimension, of the front face 152 of the body 104 and the thickness of the front face 152 face insert 108 may be different. In some embodiments, the thickness of the front face 152 of the body 104 may be greater than the thickness of the face insert 108. In particular, the thickness of an upper portion of the front face 152 located near the topline 160 and above the top edge 300 of the face insert 108 may be thicker than a lower portion of the front face 152 along the face insert 108 between the top edge 300 and the leading edge 228 near the sole 164. In some embodiments, the thickness of the upper portion of the front face 152 is smaller than the thickness of the lower portion of the front face 152. Further, the thickness of the front face 152 may vary between the sole 164 and the topline 160, or the thickness of the front face 152 may vary across the toe region 140, the medial region 144, and the heel region 148, or some combination thereof. For example, referring to FIG. 4, the upper edges 304 around the topline 160 of the body and the lower edge 308 around the leading edge 228 of the body 104 may be thicker than the front face 152 of the body 104. Accordingly, the thicker periphery or edges provide support to the overall structure and may perform as hinge points by enabling the face insert 108 and/or the front face 152 of the body 104 to depress during impact with the golf ball. The depression includes a spring-like effect, e.g., a trampoline effect, to provide improved shot distance. In some embodiments, the overall thickness of the front face 152 and the face insert 108 may be thinner than any other parts of the body 104. The thinner front face 152 provides desirable properties such as, but not limited to, improved rebound effect and reduced weight.

Turning to FIG. 8, a cross-sectional view taken along line 8-8 of FIG. 4 is shown. The lower internal cavity 252 of the body 104 defines a hollow volume within which the filler material 240 may be received. The filler material 240 may be poured or injected into the rear opening 236 (see FIG. 6), which provides access to the internal cavity 232. In some embodiments, the filler material 240 may be a polymer material (e.g., thermoplastic elastomer, thermoplastic polyurethane, etc.). In some embodiments, the filler material 240 may define a hardness between Shore A5 and Shore A40. In some embodiments, the filler material 240 may comprise between about 1% and about 10% of the total mass of the iron-type golf club head 100, or between about 2% and about 8% of the total mass, or between about 3% and 5% of the total mass, and in one instance about 4% of the total mass.

Figure 9:
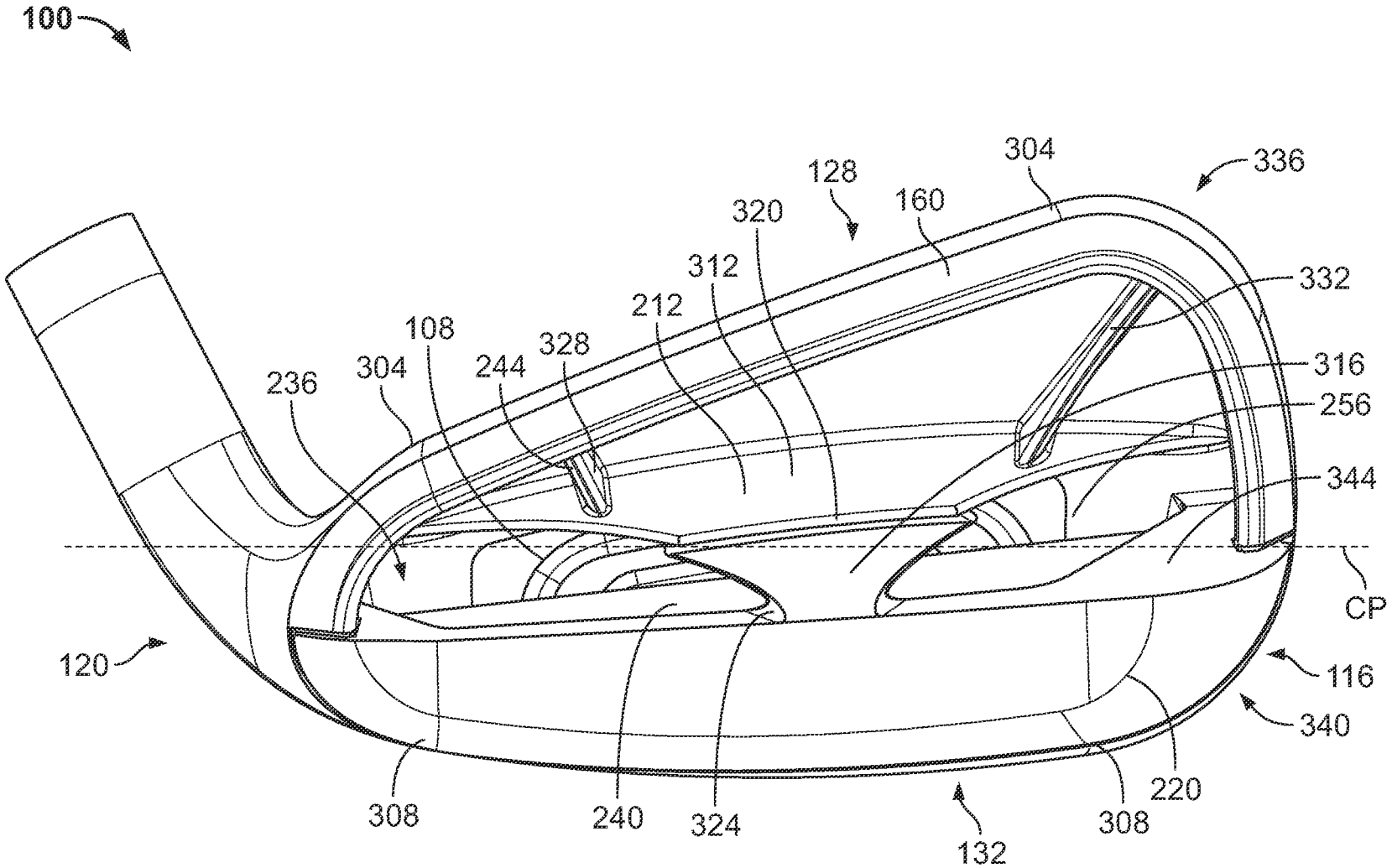
FIG. 9 is a rear elevational view of the iron-type club head of FIG. 1.
Figure 10:
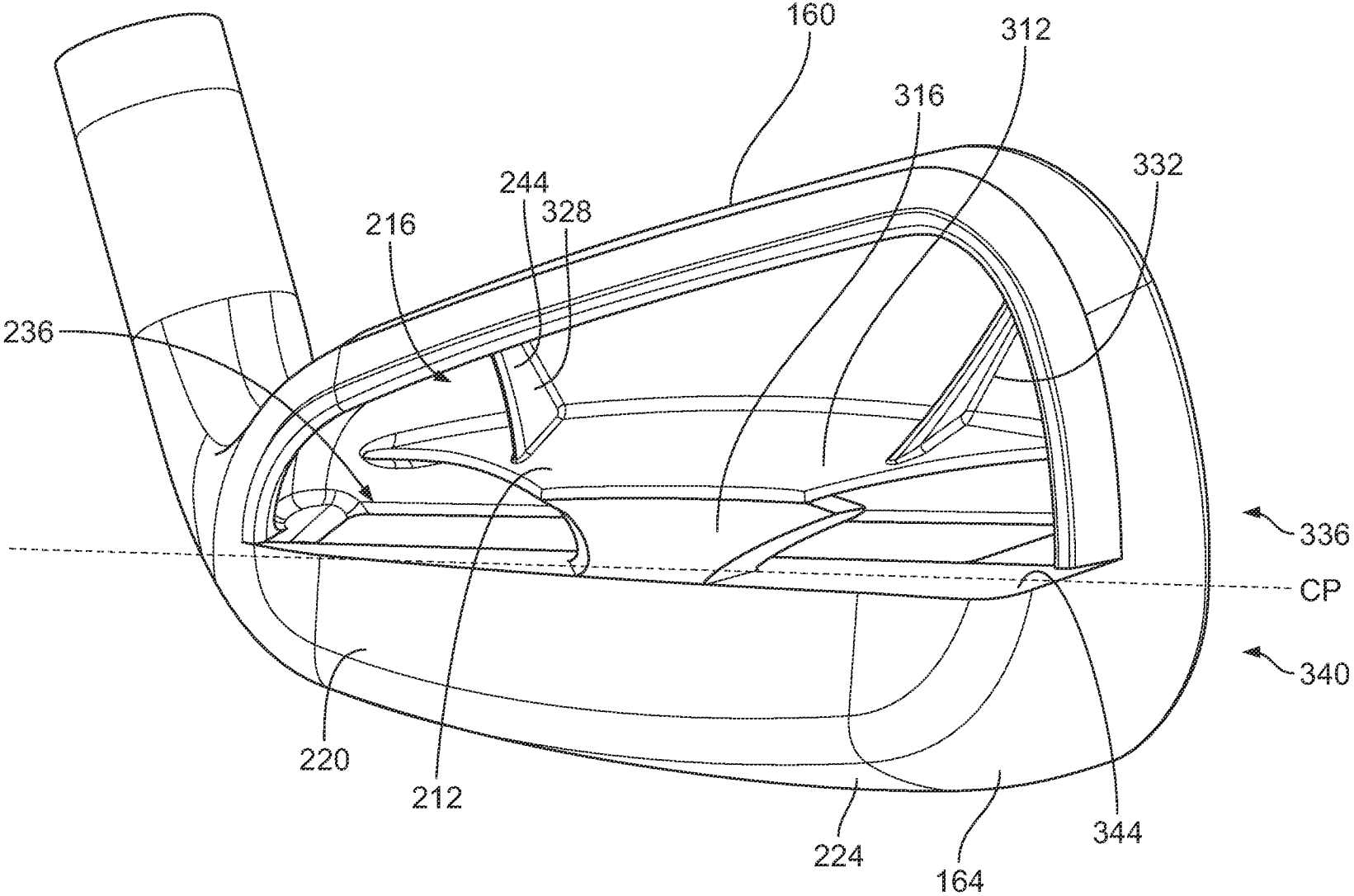
FIG. 10 is a top, rear, left isometric view of a body of the iron-type golf club head of FIG. 1.

Turning to FIGS. 9 and 10, a rear view of the iron-type golf club head 100 is shown. In the illustrated embodiment, the rear side 136 of the body includes a plurality of ribs 244, the rear opening 236, the bridge stiffener 212, and the lower rear cavity structure 220. Further, the face insert 108 is visible from the rear side 136. For example, FIG. 9 shows a representative image of a possible rear view of the golf club head body. The bridge stiffener 212 extends from the heel side 120 to the toe side 116 of the body 104 and protrudes outwardly from the inner surface 256 to form a solid arc surface 312 that narrows from the face insert 108 rearward so as to form a generally trapezoidal shape having curvilinear sides that are concavely shaped relative to the inner surface 256 of the face insert 108. A concave tab 316 of the bridge stiffener 212 extends downwardly from the arc surface 312 to the lower rear cavity structure 220. The concave tab 316 has a forwardmost edge disposed in a front-to-back direction between a forwardmost edge and a rearwardmost edge of the arc surface 312. The concave tab 316 includes an undercut element disposed between the arc surface 312 and the concave tab 316. The concave tab 316 provides additional stiffness support for the thinner front face 152. In the illustrated embodiment, an upper member 320 of the concave tab 316 may be wider than a lower member 324 of the concave tab 316. However, in some embodiments, different bridge stiffener 212 geometries and/or different tab 316 geometries that resemble the crown of a hybrid-type club may be used to connect the inner surface 256 of the body 104 to the back of the iron cavity 216. For example, the lower member 324 may be wider than the upper member 320 of the concave tab 316. In some embodiments, the bridge stiffener 212 geometries and/or different tab 316 geometries may be used to connect the inner surface 256 of the body 105 to the lower rear cavity structure 220 to form a back side that resembles a hybrid crown.

Further, the concave tab 316 at least partially defines the rear opening 236. The rear opening 236 exposes the filler material 240 occupied within the lower internal cavity 252 and, in the illustrated embodiment, also exposes the face insert 108. The rear opening 236 extends in a heel-to-toe direction and may be in communication with the lower internal cavity 252. In some embodiments, the width of the concave tab 316 may be uniform. In further embodiments, the concave tab 316 may extend from the heel-to-toe, filling or covering the rear openings 236. The bridge stiffener 212, including the concave tab 316, may be formed from materials with high stiffness, light weight, high tensile strength, high impact strength, and high ductility, such as, e.g., metal alloys. In one aspect, the bridge stiffener 212 may be formed with the body 104 as a unitary structure. Alternatively, the bridge stiffener 212 may be formed separately and then coupled to the body 104, e.g., via welding or through another technique, as would be appreciated by one of ordinary skill in the relevant art, which may facilitate making the bridge stiffener 212 from a different material than the body 104. Due to the relatively small thickness of the front face 152 near the typical impact location 192 and/or the geometric center point 188, the bridge stiffener 212, including the concave tab 316, absorbs impact forces generated at and during impact with the golf ball. As such, stress may be concentrated around the bridge stiffener 212 and the concave tab 316. Therefore, additional supporting structures, such as the plurality of ribs 244 distribute the stress concentrations and further reinforce the iron-type golf club head 100.

The ribs 244 may be located between the central plane CP and the topline 160, as illustrated in FIG. 10, to provide additional stiffness support to the bridge stiffener 212, the body 104, and the face insert 108. A first rib 328 protrudes diagonally inwardly and downwardly from the heel region 148 of the inner surface 256, and a second rib 332 protrudes diagonally inwardly and downwardly from the toe region 140 of the inner surface 256. The protruding ribs 244 extend between the topline 160 of the body 104 and the arc surface 312 of the bridge stiffener 212. The ribs 244 provide additional support to the bridge stiffener 212 by mitigating stress concentrations and distributing stress along the arc surface 312 and the body 104 of the golf club head 100.

With reference to FIGS. 8 and 9, an upper portion 336 of the golf club head 100 may comprise the topline 160 and the upper portion of the front face 152 above the central plane CP, and a lower portion 340 of the golf club head 100 may comprise the face insert 108 and the lower portion of the front face 152 below the central plane CP. In some embodiments, the upper portion 336 of the golf club head 100 may be thinner than the lower portion 340 of the golf club head 100. In this way, the center of gravity CG of the golf club head 100 may be lowered, e.g., positioned below the central plane CP. In some embodiments, the body 104 within the upper portion 336 of the golf club head 100 may be thinner than the body 104 in the lower portion of the golf club head 100. In some embodiments, the upper portion of the front face 152 is thinner than the lower portion of the front face 152, as described above. It is contemplated that the upper portion of the golf club head 100 may be reinforced by the ribs 244 to maintain the lowered center of gravity CG while providing sufficient stiffness, strength, and durability in the upper portion 336. It is further contemplated that the upper portion 336 of the golf club head 100 may be constructed from durable material, such as, e.g., titanium, steel, and/or chromium alloys.

The bridge stiffener 212 may be used as a reference to differentiate the upper portion 336 and the lower portion 340 of the iron-type golf club head 100. The upper portion 336 and the lower portion 340 of the iron-type golf club head 100 have perform different functions. The upper portion 336 provides functionalities such as, e.g., reduced weight, and increased durability and stiffness, whereas the lower portion 340 provides functionalities such as, e.g., flexibility, mass concentration, and increased COR. In the present disclosure, the lower portion 340 of the body 104 comprises the lower rear cavity structure 220 in the hybrid crown shape and the face insert 108 having the thinned front face 152 adjacent the filler material 240 for improved sound performance and energy return, while the upper portion 336 includes the plurality of ribs 244 and the body 104 to provide stiffness and reduce weight.

Figure 11:
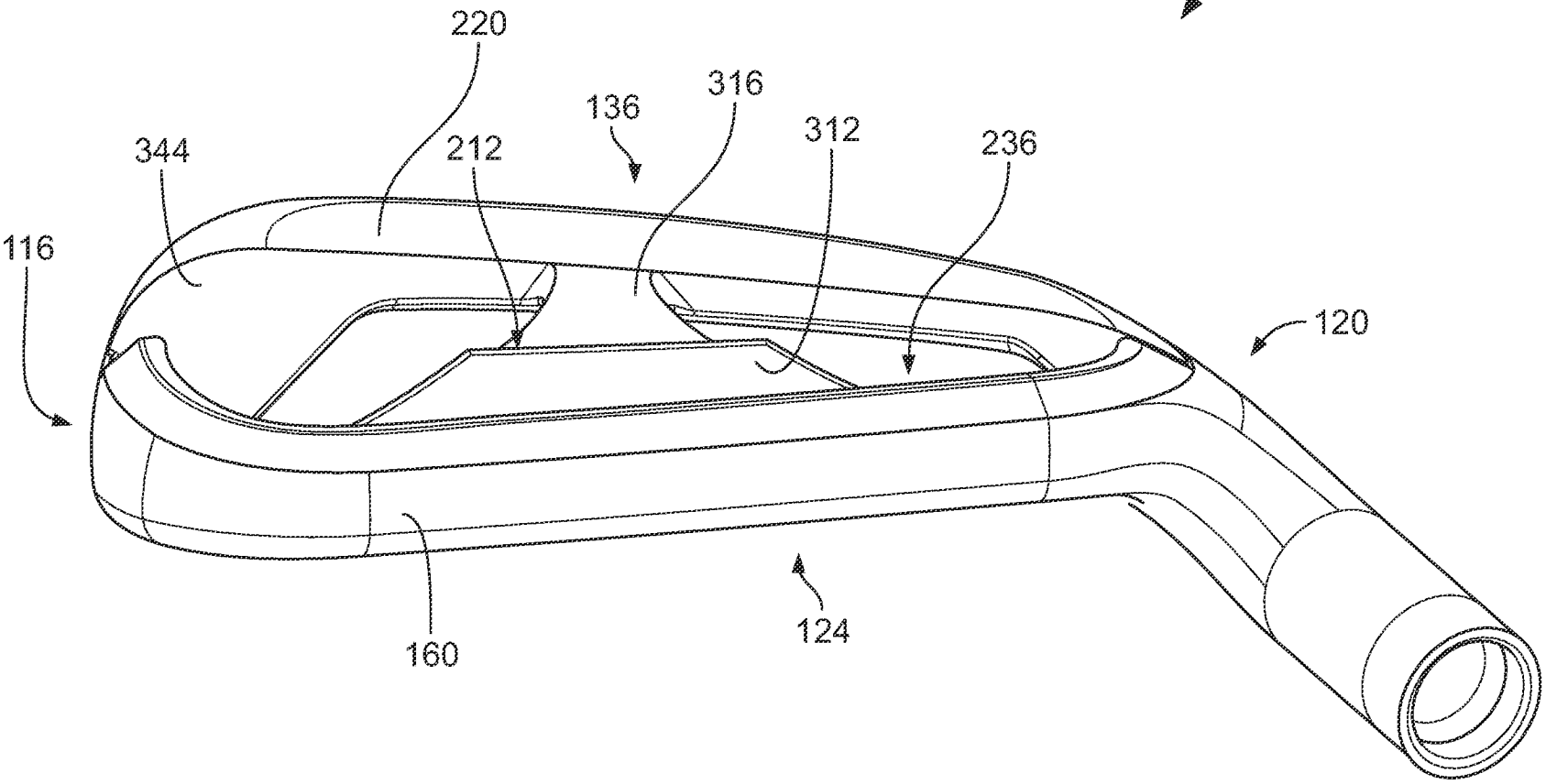
FIG. 11 is a top plan view of the iron-type club golf club head of FIG. 1.

FIG. 11 depicts a top view of the iron-type golf club head 100 with the concave tab 316 extending from the top surface 344 of the lower rear cavity structure 220. The top surface 344 of the lower rear cavity structure 220 extends in the heel-to-toe direction. Inheriting the shape of a hybrid crown, the lower rear cavity structure 220 is formed on or near the rear side 136 of iron-type golf club head 100. However, the location of the lower internal cavity 252 in the present disclosure is lower, i.e. closer to the sole 164, than that of the typical crown of a hybrid-type golf club. Accordingly, the height of the lower internal cavity 252 may be about 20% of a body height that is defined between the topline 160 and the sole 164, or about 30% of the body height, or about 40% of the body height, or about 50% of the body height.

The thickness of the iron-type golf club head 100 may be different depending on the area of the body 104. As mentioned above, the upper 304 and lower edges 308 of the body 104 may be thicker in comparison to the front face 152 and the face insert 108. For example, the thickness across the leading edge 228 may be about 1.5 mm. In some embodiments, the upper portion 336 of the body may be thinned along the topline 160, the heel side 120, the toe side 116, the top side of the body 104, and the impact area. The thinned body 104 is reinforced by the ribs 244 and the bridge stiffener 212. The thinned body 104 may include lightweight metal alloys with high tensile strength, high impact strength, and high ductility. In further embodiments, the entire body 104 may include a solid thin shell structure with reinforcing rib structures 244.

Figure 12:
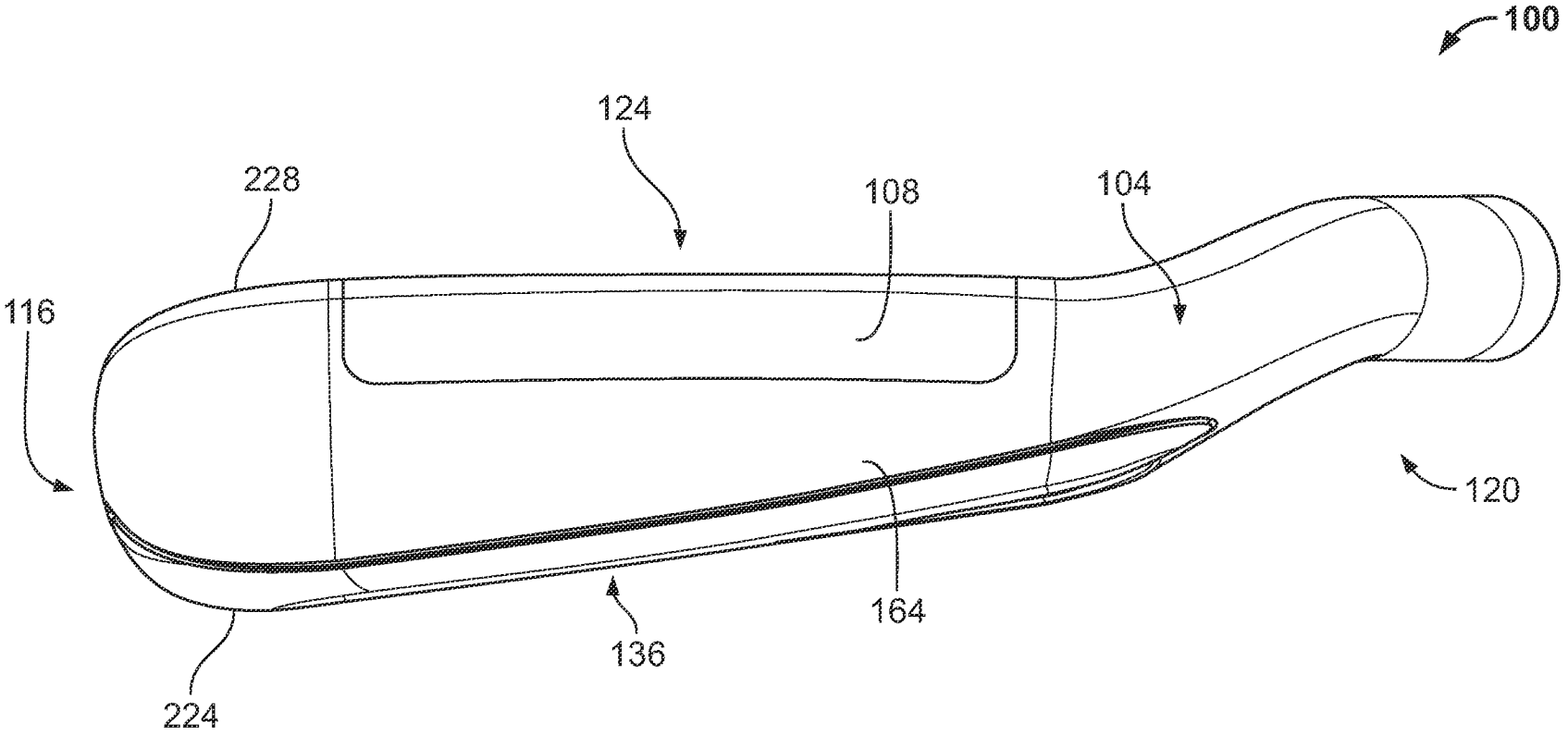
FIG. 12 is a bottom plan view of the iron-type club head of FIG. 1.

Turning to FIG. 12, the bottom view including the sole 164 and the sole portion 296 of the face insert 108 is shown. In comparison to a typical iron-type golf club, the distance between the front side 124 and the rear side 136 of the sole 164, or the width of the sole 164, may be wider due to the lower rear cavity structure 220 being defined near the trailing edge 224. The width of the sole 164 may be wider by about 5%, or by about 10%, or by about 15%, or by about 20% of a typical iron-type golf club.

The present disclosure may be directed to an iron-type golf club head 100 that is produced using an additive manufacturing process (e.g., printed layer-by-layer). In particular, the body 104 may be manufactured using an additive manufacturing process and may be fabricated from a metal material or metal alloy. Various methods of additive manufacturing can be used to manufacture the golf club heads according to the present disclosure, such as, e.g., binder jetting, direct energy deposition, selective laser melting, direct metal laser sintering, fused deposition modeling, electron beam melting, laser powered bed fusion, ultrasonic additive manufacturing, material extrusion, material jetting, electrochemical deposition, cold spray metal printing, DLP metal printing, or another additive manufacturing method. In some embodiments, the body 104 of the iron-type club head 100 may be formed from metallic and/or non-metallic materials. For example, the body 104 may be formed entirely from any one of or a combination of aluminum, bronze, brass, copper, stainless steel, carbon steel, titanium, zinc, polymeric materials, and/or any other suitable materials.

In some embodiments, the iron-type golf club head 100 may be manufactured with a greater thickness, or other dimensions, in order to mitigate warping and distortion of the golf club body 104. The larger dimensional part may be machined (e.g., via milling, turning) to obtain, for example, the loft, the lie, weight, dimensions, volume, shape, etc., defined by the factory finish. In some embodiments, the iron-type golf club head 100 may include an aperture (not shown) along the body 104 to allow excess materials to be removed during or after a manufacturing process, such as, e.g., an additive manufacturing process in which resin or powder is removed. Various apertures or cavities may be present along the portions of the iron-type golf club head 100 to assist with stages of the manufacturing process, such as, e.g., to remove or extract excess materials, or to provide access for machining or finishing. The excess materials may be removed using an air moving device such as a blower or a vacuum or tools including brushes, chisels, picks or other implements that may assist with manually removing the excess material within the iron-type golf club head 100.

Figure 13:
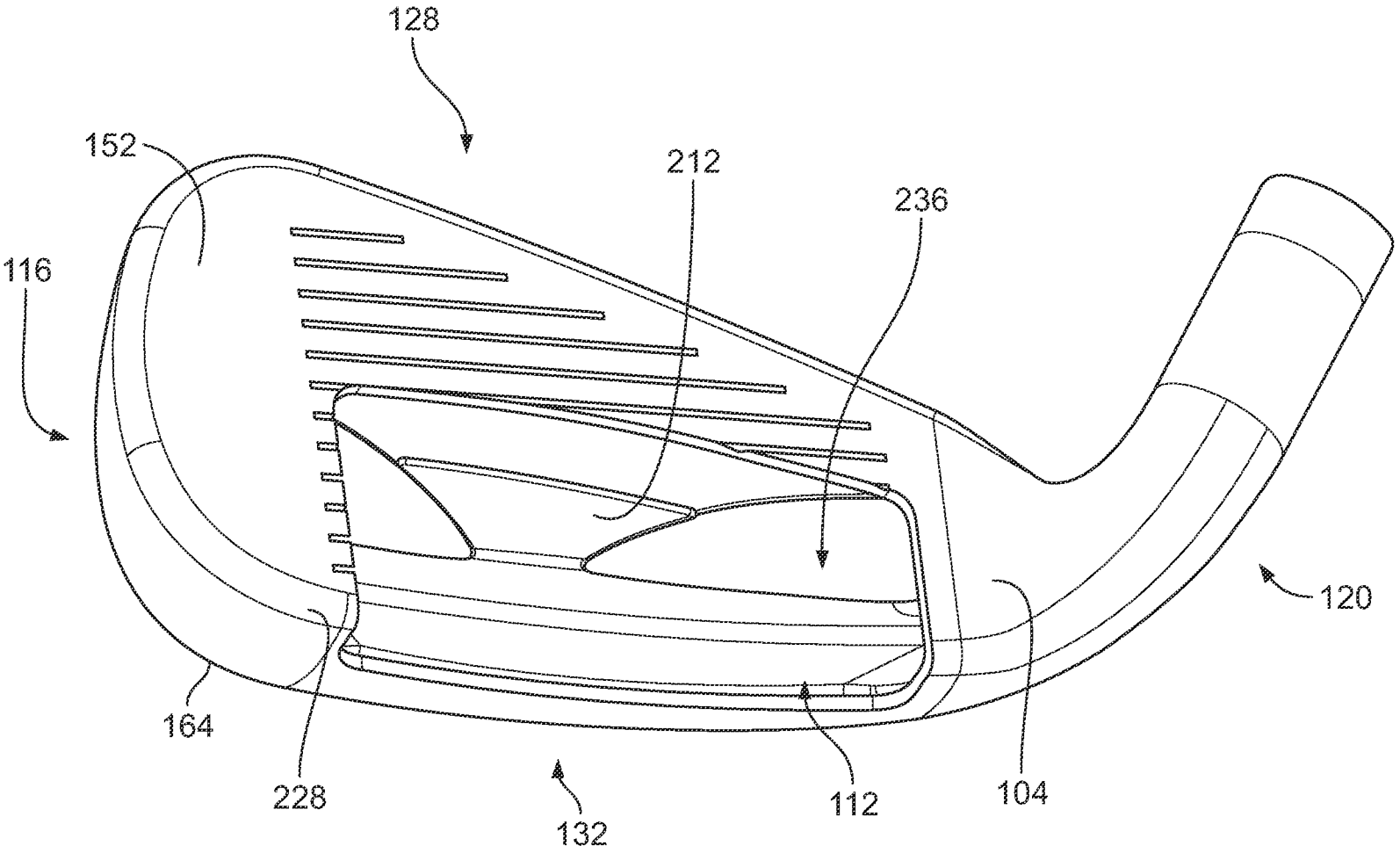
FIG. 13 is a bottom, front, left isometric view of the body of the iron-type golf club head of FIG. 1 with the face insert removed for clarity.
Figure 14:
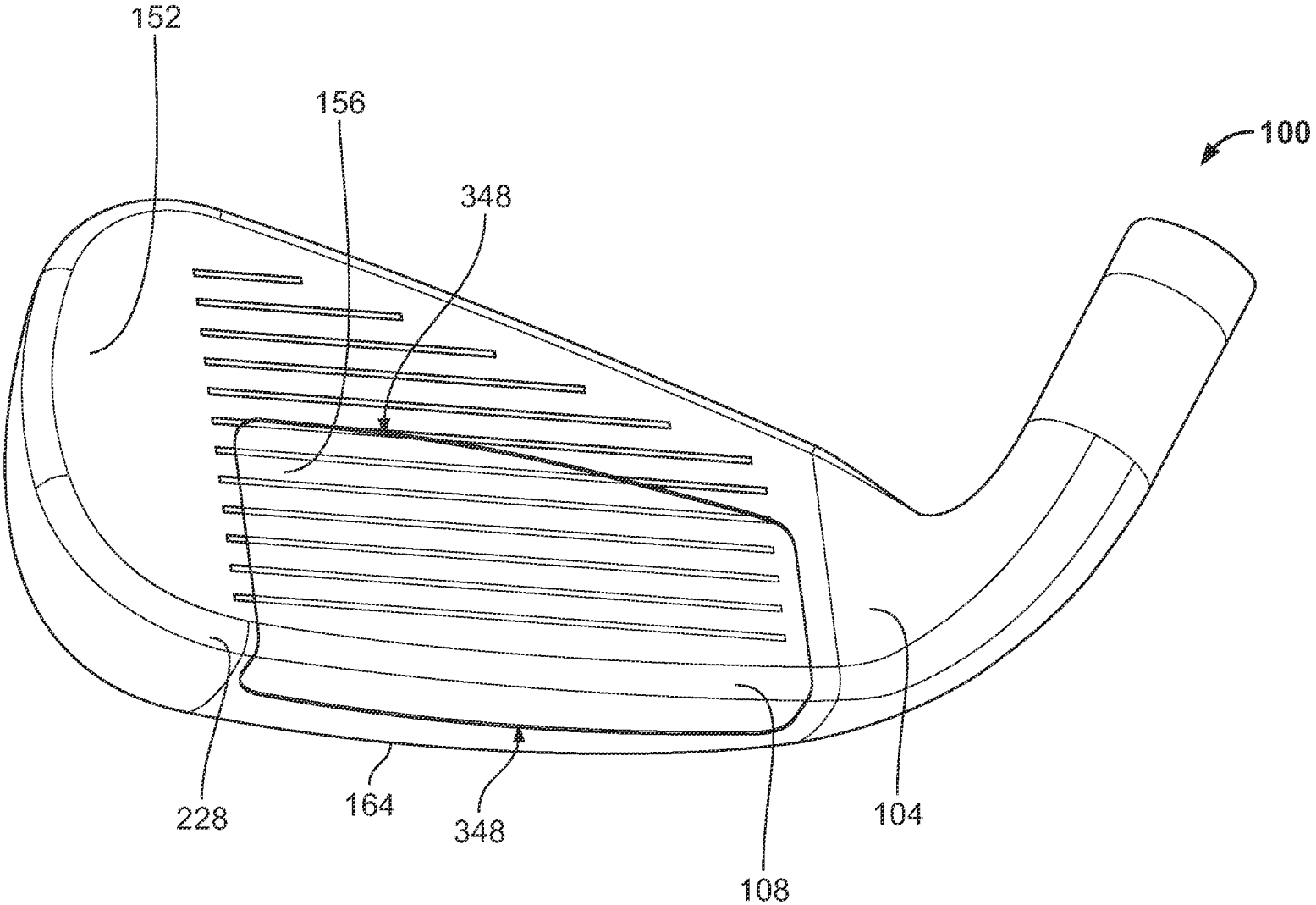
FIG. 14 is a bottom, front, left isometric view of the body of the iron-type golf club head of FIG. 1 with the face insert highlighted.

Turning to FIGS. 13 and 14, the front face 152 with and without the face insert 108 is shown. The face insert 108 is defined within the medial region 144 of the club body and may extend at least partially onto one or more of the toe and/or heel regions. The face insert 108 extends from the sole 164 of the body 104 to the front face 152 of the body along the medial region 144. The face insert 108 may extend vertically about 15%, or about 20%, or about 25%, or about 30%, or about 35%, or about 40%, or about 45%, or about 50%, or about 55%, or about 60% of the body height.

Figure 15:
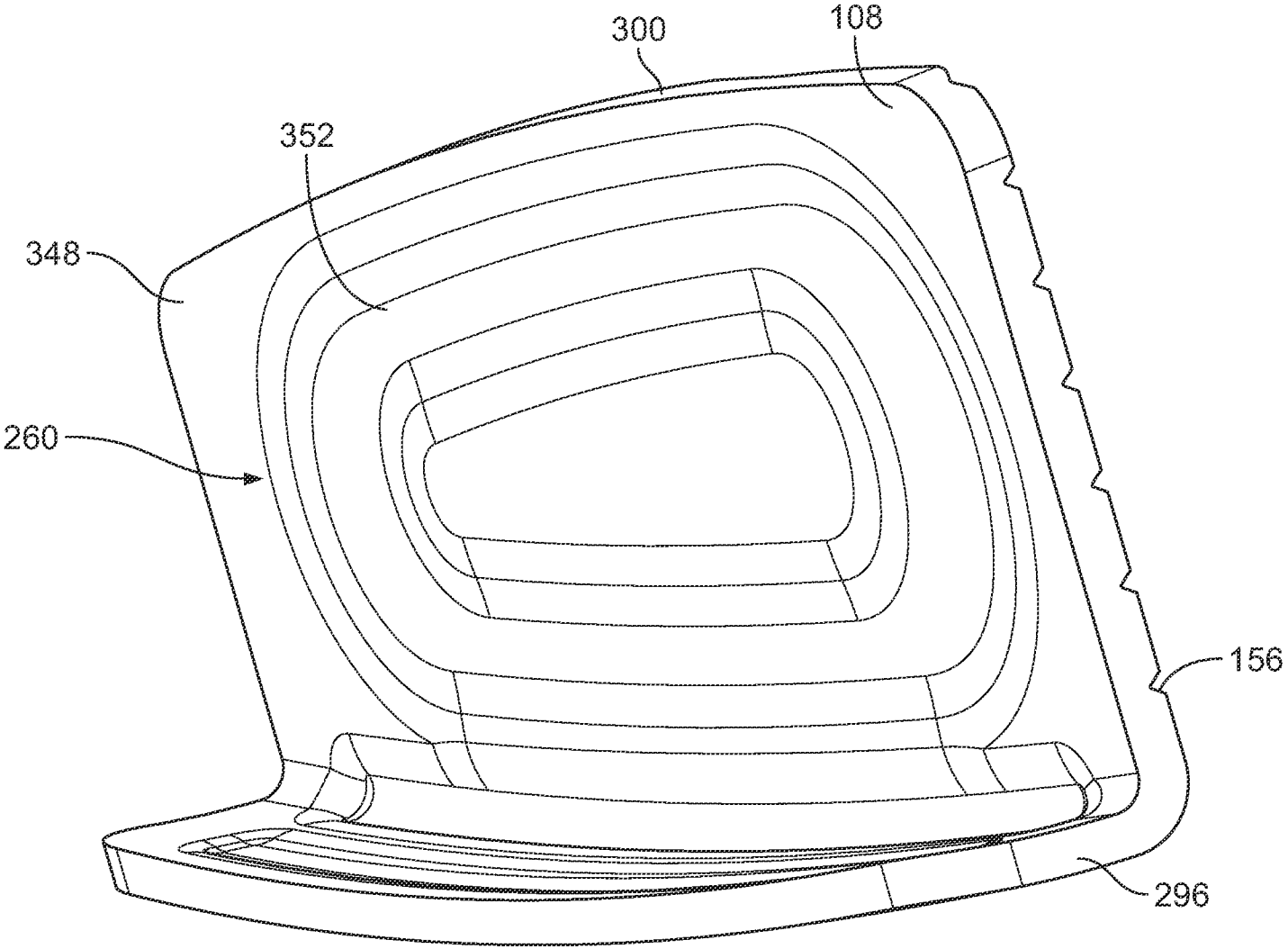
FIG. 15 is a top, rear, left isometric view of the face insert of the iron-type golf club head of FIG. 1.

Referring to FIG. 15, the face insert 108 is shown. The outer perimeter 348 of the face insert 108 is welded to the face insert cavity 112. The face insert 108 includes the plurality of grooves 156 along the front face 152 of the face insert 108. The inner face insert surface 260 of the face insert 108 may define a variable face thickness, e.g., by comprising a plurality of concentric oval-shaped zones 352. The zones 352 may be centered about a desired maximum COR location of the face insert 108, which may be spaced approximately halfway between the top edge 300 and the sole portion 296, and centrally in the toe-to-heel direction between opposing ends of the plurality of grooves 156. In some examples, a center of the zones 352 may be located at between about 11 mm and about 19 mm upwards from the sole portion 296 of the face insert 108 in one aspect, and between about 11 mm and about 15 mm upwards from the sole portion 296 in another aspect. Additionally, the sole portion 296 may include variable thickness therealong in, e.g., the front-rear direction, or the heel-toe direction, or some combination thereof. Additionally or alternatively, the sole portion 296 may include concentric zones, similar to the zones 352, of varying thickness.

Figure 16:
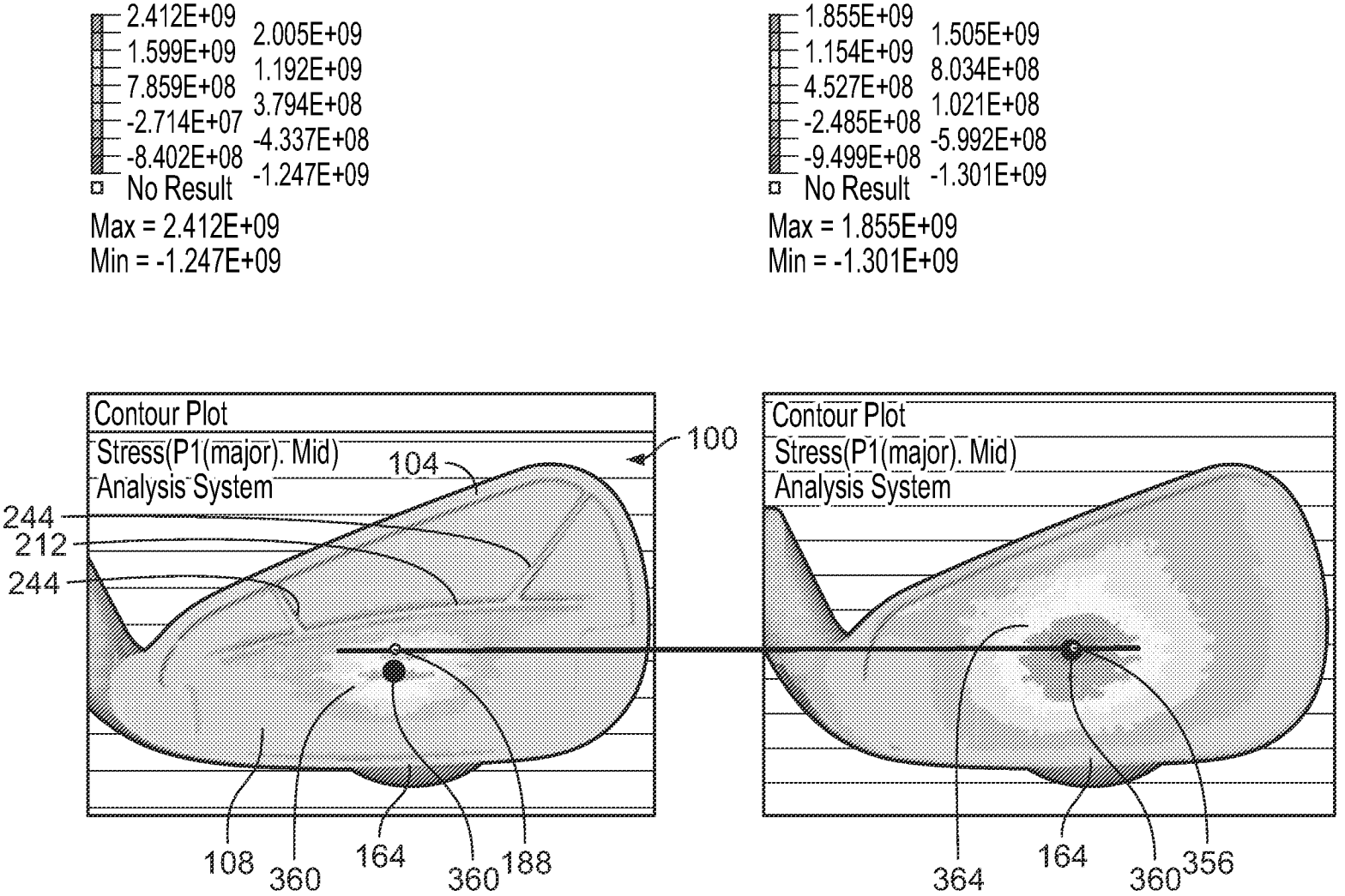
FIG. 16 is a schematic representation of results of a finite element analysis (FEA) simulation showing a front view of the iron-type club head of FIG. 1 side-by-side with another iron-type golf club head.

FIG. 16 depicts a schematic representation of a comparison of the results of a finite element analysis (FEA) simulation between models of a conventional iron-type golf club and the iron-type golf club head 100 of present disclosure. For purposes of comparison in the FEA simulation, the golf club heads were designed to have similar dimensions, e.g., identical body height, such that the geometric center point 188 of the iron-type golf club head 100 corresponds with a geometric face center 356 of the conventional iron-type golf club head. However, the iron-type golf club head 100 of the present disclosure includes the body 104 having the lower rear cavity structure 220, the plurality of ribs 244, the bridge stiffener 212, and the face insert 108, as described above. As shown by the results of the FEA simulation, a maximum stress point 360 of the typical iron-type golf club is located higher, i.e., farther from the sole 164, than the maximum stress point 360 of the iron-type golf club head 100. In particular, the maximum stress point 360 of the conventional iron-type golf club head coincides with the geometric face center 356. The FEA results further illustrate high stress concentrations 364 of the conventional iron-type golf club distributed around the geometric face center 356. By contrast, the iron-type golf club head 100 of the present disclosure includes the stress concentrations 364 distributed near the comparatively lowered maximum stress point 360, which is below the geometric center point 188. According to Newton's third law of motion, when two bodies interact, the two bodies apply forces to one another that are equal in magnitude and opposite in direction. Therefore, stress concentrations 364 around the geometric face center 356 may be indicate a high COR in those areas. FIG. 16 illustrates that the COR "hot spot" may be lowered in the iron-type golf club head 100, with all the features and geometries described above, as compared with the conventional iron-type golf club head. Accordingly, the COR "hot spot" may be lowered to coincide with the typical impact point 192 (see FIG. 1) of the iron-type golf club head 100.

By including ribs, rods, and/or support structures, the deflection pattern of the club may be controlled. In conventional hollow iron-type golf clubs, the striking face has the COR "hot spot" at the geometric center where the striking face experiences the largest deflection and provides increased shot distances and increased launch velocity to the golf ball at or during impact. However, in many situations, the impact location is below the geometric face center of the striking face, which inhibits the shot distance and launch velocity of the golf ball. Often, iron-type golf clubs are used to hit golf balls out of the rough, along the fairway, or in other positions where making contact with the golf ball is obstructed or challenged by the surroundings. The present disclosure provides for a lowered COR "hot spot" that is shifted downwardly from the geometric face center to correspond with a more typical impact location in those obstructed or challenged situations. Accordingly, the COR "hot spot" is provided by the thinned front face 152 to maximize the deflection of the face insert 108 at or near the typical impact location 192. In addition, the face insert 108 may comprise ductile material that enables greater deflection and provides improved launch velocity. In some embodiments, the ribs 244 and the bridge 212 stiffener may be reduced in size, e.g., thinned or narrowed, to increase the deflection of the striking face. In some embodiments, the arc surface 312 of the bridge stiffener 212 may be reduced in size, e.g., thinned or narrowed. The ribs 244 and the bridge stiffener 212 may be provided in a variety of configurations and may take alternative forms than as shown and described above.

Alternatively, in certain situations such as when the golf ball is sitting up in the rough—what is commonly known as a "flyer lie"—the golf ball impact may occur at the higher geometric face center and the golf ball may be launched at a higher angle with less spin, which imparts more distance on the ball. In conventional higher COR iron designs, this added launch angle and reduced spin that is coupled with higher ball velocity results in a substantially father-than-expected shot, which could prove to be disastrous if not planned for. With the typical player who ordinarily contacts the ball at a point below the geometric face center, contact in such situations instead may be made at or nearer to that geometric face center, so that the reduced COR in the present golf club head at that contact point may serve to counteract or compensate for the higher launch angle and reduced spin, resulting in an overall more consistent shot performance regardless of where the ball is hit on the face.

Any of the embodiments described herein may be modified to include any of the structures or methodologies disclosed in connection with different embodiments. Further, the present disclosure is not limited to golf clubs of the type specifically shown. Still further, aspects of the golf club heads of any of the embodiments disclosed herein may be modified to work with any type of golf club.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A golf club head, comprising:

a body including a toe region, a heel region, a medial region extending between the toe region and the heel region, and a sole; and a face insert that is coupled to the body, the face insert and the body combining to form a front face on a front side, wherein an ideal impact point of the front face is located between the sole and a topline, wherein a top edge of the face insert is disposed within a face insert cavity and located between a central plane and the topline of the body, wherein the face insert extends about 60% or less of a body height defined between the topline and the sole, wherein an inner surface of the face insert includes a plurality of concentric zones of varying thickness centered about the ideal impact point, wherein the body further includes a lower cavity structure extending between the sole and an upper middle part of the front face, and wherein a majority of the lower cavity structure is located below the central plane.

2. The golf club head of claim 1, wherein the face insert defines less than about 50% of a surface area of the front face.

3. The golf club head of claim 1, wherein the face insert includes a sole portion that is coupled to the sole.

4. The golf club head of claim 1, wherein a bridge stiffener connects the face insert to a rear structure of the body.

5. A golf club head, comprising:

a body that includes a face insert cavity; and a face insert that is received within the face insert cavity, wherein a front face is defined by the body and the face insert on a front side, wherein the body includes a bridge stiffener extending rearwardly from the front face, wherein the bridge stiffener connects the face insert to a rear structure of the body, wherein the rear structure of the body extends from a trailing edge of the body to the bridge stiffener and at least partially defines an internal cavity between the rear structure and the face insert, wherein a filler insert is disposed in the internal cavity, the filler insert comprising at least one material having a hardness that is between about Shore A5 and about Shore A40, and wherein the bridge stiffener includes a convex portion or a concave portion extending between the rear structure of the body and the face insert.

6. The golf club head of claim 5, wherein the internal cavity includes an upper internal cavity and a lower internal cavity, the bridge stiffener separating the upper internal cavity from the lower internal cavity.

7. The golf club head of claim 5, wherein the concave portion defines a concave tab that extends downwardly from the bridge stiffener to the rear structure.

8. The golf club head of claim 7, wherein the concave tab forms a rear opening in communication with the internal cavity, the internal cavity being exposed through the rear opening.

9. The golf club head of claim 5, wherein the filler insert includes a polymer material.

10. The golf club head of claim 9, wherein the polymer material is a thermoplastic polyurethane or a thermoplastic elastomer.

11. A golf club head, comprising:

a body that includes a face insert cavity; and a face insert that is received within the face insert cavity, wherein a front face is defined by the body and the face insert on a front side, wherein the body includes a bridge stiffener extending rearwardly from the front face, wherein the bridge stiffener extends across the body from a heel region to a toe region at an intersection with an inner surface of the front face, wherein the bridge stiffener separates an upper internal cavity from a lower internal cavity, the bridge stiffener including at least one of a concave portion and a convex portion, wherein a filler insert is disposed in the lower internal cavity, the filler insert comprising at least one material defining a hardness between about Shore A5 and about Shore A40, wherein a geometric center of the front face is located between a topline of the body and a sole of the body, and wherein a central plane of the golf club head extends through the geometric center of the front face, wherein the body further includes a lower cavity structure extending between the sole and an upper middle part of the front face, and wherein a majority of the lower cavity structure is located below the central plane.

12. The golf club head of claim 11, wherein a height of the lower internal cavity is about 20% of a body height defined between the topline of the body and the sole of the body.

13. The golf club head of claim 11, wherein the body further includes an upper cavity structure, and wherein a first thickness of the upper cavity structure is less than a second thickness of the lower cavity structure.

14. The golf club head of claim 11, wherein the filler insert includes a polymer material.

15. The golf club head of claim 14, wherein the polymer material is a thermoplastic polyurethane or a thermoplastic elastomer.

* * * * *